US008382521B2

(12) United States Patent
Minich et al.

(10) Patent No.: US 8,382,521 B2
(45) Date of Patent: Feb. 26, 2013

(54) SHIELDLESS, HIGH-SPEED, LOW-CROSS-TALK ELECTRICAL CONNECTOR

(75) Inventors: Steven E. Minich, York, PA (US); Douglas M. Johnescu, York, PA (US); Stefaan Hendrik Jozef Sercu, Wuustwezel (BE); Jonathan E. Buck, Hershey, PA (US)

(73) Assignees: FCI Americas Technology LLC, Carson City, NV (US); FCI, Guyancourt (FR)

( * ) Notice: Subject to any disclaimer, the term of this patent is extended or adjusted under 35 U.S.C. 154(b) by 0 days.

(21) Appl. No.: 13/310,970

(22) Filed: Dec. 5, 2011

(65) Prior Publication Data

US 2012/0083155 A1 Apr. 5, 2012

Related U.S. Application Data

(60) Continuation of application No. 12/843,735, filed on Jul. 26, 2010, now Pat. No. 8,096,832, which is a continuation of application No. 12/396,086, filed on Mar. 2, 2009, now Pat. No. 7,762,843, which is a division of application No. 11/958,098, filed on Dec.

(Continued)

(51) Int. Cl.
*H01R 13/648* (2006.01)

(52) U.S. Cl. ..... 439/607.05; 439/79; 439/941

(58) Field of Classification Search ..... 439/79, 439/607.05, 701, 108, 941, 607.07, 607.08, 439/607.09, 607.11

See application file for complete search history.

(56) References Cited

U.S. PATENT DOCUMENTS

| | | | |
|---|---|---|---|
| 2,858,372 | A | 10/1958 | Kaufman |
| 3,115,379 | A | 12/1963 | McKee |
| 3,286,220 | A | 11/1966 | Marley et al. |
| 3,343,120 | A | 9/1967 | Whiting |
| 3,482,201 | A | 12/1969 | Schneck |
| 3,538,486 | A | 11/1970 | Shlesinger, Jr. |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |
| 3,827,005 | A | 7/1974 | Friend |

(Continued)

FOREIGN PATENT DOCUMENTS

| | | |
|---|---|---|
| EP | 0273683 A2 | 7/1988 |
| EP | 0635910 A2 | 1/1995 |

(Continued)

OTHER PUBLICATIONS

U.S. Appl. No. 11/726,936, filed Mar. 23, 2007, Minich.

(Continued)

*Primary Examiner* — Javaid Nasri
(74) *Attorney, Agent, or Firm* — Woodcock Washburn LLP

(57) ABSTRACT

An electrical connector may include a first connector with electrically-conductive contacts. The contacts may have blade-shaped mating ends, and may be arranged in a centerline. The electrical connector may include a second connector with electrically-conductive receptacle contacts, which may also be arranged in a centerline. The connectors may be mated such that the mating portion of a first contact in the second connector may physically contact of a corresponding blade-shaped mating end of a contact in the first connector.

31 Claims, 20 Drawing Sheets

Related U.S. Application Data

17, 2007, now Pat. No. 7,497,736, which is a continuation-in-part of application No. 11/726,936, filed on Mar. 23, 2007, now Pat. No. 7,503,804.

(60) Provisional application No. 60/870,791, filed on Dec. 19, 2006, provisional application No. 60/870,793, filed on Dec. 19, 2006, provisional application No. 60/870,796, filed on Dec. 19, 2006, provisional application No. 60/887,081, filed on Jan. 29, 2007, provisional application No. 60/917,491, filed on May 11, 2007.

(56) References Cited

U.S. PATENT DOCUMENTS

| | | | |
|---|---|---|---|
| 3,867,008 | A | 2/1975 | Gartland, Jr. |
| 4,030,792 | A | 6/1977 | Fuerst |
| 4,076,362 | A | 2/1978 | Ichimura |
| 4,159,861 | A | 7/1979 | Anhalt |
| 4,232,924 | A | 11/1980 | Kline et al. |
| 4,260,212 | A | 4/1981 | Ritchie et al. |
| 4,288,139 | A | 9/1981 | Cobaugh et al. |
| 4,383,724 | A | 5/1983 | Verhoeven |
| 4,402,563 | A | 9/1983 | Sinclair |
| 4,482,937 | A | 11/1984 | Berg |
| 4,523,296 | A | 6/1985 | Healy, Jr. |
| 4,560,222 | A | 12/1985 | Dambach |
| 4,664,456 | A | 5/1987 | Blair et al. |
| 4,664,458 | A | 5/1987 | Worth |
| 4,717,360 | A | 1/1988 | Czaja |
| 4,762,500 | A | 8/1988 | Dola et al. |
| 4,776,803 | A | 10/1988 | Pretchel et al. |
| 4,815,987 | A | 3/1989 | Kawano et al. |
| 4,850,887 | A | 7/1989 | Sugawara |
| 4,867,713 | A | 9/1989 | Ozu et al. |
| 4,898,539 | A | 2/1990 | Glover et al. |
| 4,900,271 | A | 2/1990 | Colleran et al. |
| 4,907,990 | A | 3/1990 | Bertho et al. |
| 4,913,664 | A | 4/1990 | Dixon et al. |
| 4,917,616 | A | 4/1990 | Demler, Jr. et al. |
| 4,973,271 | A | 11/1990 | Ishizuka et al. |
| 4,997,390 | A | 3/1991 | Scholz et al. |
| 5,004,426 | A | 4/1991 | Barnett |
| 5,046,960 | A | 9/1991 | Fedder |
| 5,055,054 | A | 10/1991 | Doutrich |
| 5,065,282 | A | 11/1991 | Polonio |
| 5,066,236 | A | 11/1991 | Broeksteeg |
| 5,077,893 | A | 1/1992 | Mosquera et al. |
| 5,094,623 | A | 3/1992 | Scharf et al. |
| 5,098,311 | A | 3/1992 | Roath et al. |
| 5,127,839 | A | 7/1992 | Korsunsky et al. |
| 5,161,987 | A | 11/1992 | Sinisi |
| 5,163,337 | A | 11/1992 | Herron et al. |
| 5,163,849 | A | 11/1992 | Fogg et al. |
| 5,167,528 | A | 12/1992 | Nishiyama et al. |
| 5,169,337 | A | 12/1992 | Ortega et al. |
| 5,174,770 | A | 12/1992 | Sasaki et al. |
| 5,181,855 | A | 1/1993 | Mosquera et al. |
| 5,238,414 | A | 8/1993 | Yaegashi et al. |
| 5,254,012 | A | 10/1993 | Wang |
| 5,257,941 | A | 11/1993 | Lwee et al. |
| 5,274,918 | A | 1/1994 | Reed |
| 5,277,624 | A | 1/1994 | Champion et al. |
| 5,286,212 | A | 2/1994 | Broeksteeg |
| 5,288,949 | A | 2/1994 | Crafts |
| 5,302,135 | A | 4/1994 | Lee |
| 5,342,211 | A | 8/1994 | Broeksteeg |
| 5,356,300 | A | 10/1994 | Costello et al. |
| 5,356,301 | A | 10/1994 | Champion et al. |
| 5,357,050 | A | 10/1994 | Baran et al. |
| 5,382,168 | A | 1/1995 | Azuma et al. |
| 5,387,111 | A | 2/1995 | DeSantis et al. |
| 5,395,250 | A | 3/1995 | Englert, Jr. et al. |
| 5,429,520 | A | 7/1995 | Morlion et al. |
| 5,431,578 | A | 7/1995 | Wayne |
| 5,475,922 | A | 12/1995 | Tamura et al. |
| 5,522,727 | A | 6/1996 | Saito et al. |
| 5,558,542 | A | 9/1996 | O'Sullivan et al. |
| 5,575,688 | A | 11/1996 | Crane, Jr. |
| 5,586,908 | A | 12/1996 | Lorrain |
| 5,586,914 | A | 12/1996 | Foster, Jr. et al. |
| 5,590,463 | A | 1/1997 | Feldman et al. |
| 5,609,502 | A | 3/1997 | Thumma |
| 5,634,821 | A | 6/1997 | Crane, Jr. |
| 5,637,019 | A | 6/1997 | Crane, Jr. et al. |
| 5,672,064 | A | 9/1997 | Provencher et al. |
| 5,697,799 | A | 12/1997 | Consoli et al. |
| 5,713,746 | A | 2/1998 | Olson et al. |
| 5,730,609 | A | 3/1998 | Harwath |
| 5,741,144 | A | 4/1998 | Elco et al. |
| 5,741,161 | A | 4/1998 | Cahaly et al. |
| 5,766,023 | A | 6/1998 | Noschese et al. |
| 5,795,191 | A | 8/1998 | Preputnick et al. |
| 5,817,973 | A | 10/1998 | Elco |
| 5,833,475 | A | 11/1998 | Mitra |
| 5,853,797 | A | 12/1998 | Fuchs et al. |
| 5,860,816 | A | 1/1999 | Provencher et al. |
| 5,871,362 | A | 2/1999 | Campbell et al. |
| 5,876,222 | A | 3/1999 | Gardner et al. |
| 5,887,158 | A | 3/1999 | Sample |
| 5,892,791 | A | 4/1999 | Moon |
| 5,893,761 | A | 4/1999 | Longueville |
| 5,902,136 | A | 5/1999 | Lemke et al. |
| 5,904,581 | A | 5/1999 | Pope et al. |
| 5,908,333 | A | 6/1999 | Perino et al. |
| 5,938,479 | A | 8/1999 | Paulson et al. |
| 5,961,355 | A | 10/1999 | Morlion et al. |
| 5,967,844 | A | 10/1999 | Doutrich et al. |
| 5,971,817 | A | 10/1999 | Longueville |
| 5,975,921 | A | 11/1999 | Shuey |
| 5,980,321 | A | 11/1999 | Cohen et al. |
| 5,984,690 | A | 11/1999 | Riechelmann et al. |
| 5,992,953 | A | 11/1999 | Rabinovitz |
| 5,993,259 | A | 11/1999 | Stokoe et al. |
| 6,022,227 | A | 2/2000 | Huang |
| 6,042,427 | A | 3/2000 | Adriaenssens et al. |
| 6,050,862 | A | 4/2000 | Ishii |
| 6,068,520 | A | 5/2000 | Winings et al. |
| 6,086,386 | A | 7/2000 | Fjelstad et al. |
| 6,116,926 | A | 9/2000 | Ortega et al. |
| 6,116,965 | A | 9/2000 | Arnett et al. |
| 6,123,554 | A | 9/2000 | Ortega et al. |
| 6,125,535 | A | 10/2000 | Chiou et al. |
| 6,129,592 | A | 10/2000 | Mickievicz et al. |
| 6,132,255 | A | 10/2000 | Verhoeven |
| 6,139,336 | A | 10/2000 | Olson |
| 6,146,157 | A | 11/2000 | Lenoir et al. |
| 6,146,203 | A | 11/2000 | Elco et al. |
| 6,152,747 | A | 11/2000 | McNamara |
| 6,154,742 | A | 11/2000 | Herriot |
| 6,171,115 | B1 | 1/2001 | Mickievicz et al. |
| 6,171,149 | B1 | 1/2001 | Van Zanten |
| 6,179,663 | B1 | 1/2001 | Bradley et al. |
| 6,190,213 | B1 | 2/2001 | Reichart et al. |
| 6,212,755 | B1 | 4/2001 | Shimada et al. |
| 6,219,913 | B1 | 4/2001 | Uchiyama |
| 6,220,896 | B1 | 4/2001 | Bertoncini et al. |
| 6,227,882 | B1 | 5/2001 | Ortega et al. |
| 6,241,535 | B1 | 6/2001 | Lemke et al. |
| 6,267,604 | B1 | 7/2001 | Mickievicz et al. |
| 6,269,539 | B1 | 8/2001 | Takahashi et al. |
| 6,280,209 | B1 | 8/2001 | Bassler et al. |
| 6,280,809 | B1 | 8/2001 | Wang et al. |
| 6,293,827 | B1 | 9/2001 | Stokoe |
| 6,299,483 | B1 | 10/2001 | Cohen et al. |
| 6,302,711 | B1 | 10/2001 | Ito |
| 6,319,075 | B1 | 11/2001 | Clark et al. |
| 6,322,379 | B1 | 11/2001 | Ortega et al. |
| 6,322,393 | B1 | 11/2001 | Doutrich et al. |
| 6,328,602 | B1 | 12/2001 | Yamasaki et al. |
| 6,343,955 | B2 | 2/2002 | Billman et al. |
| 6,347,952 | B1 | 2/2002 | Hasegawa et al. |
| 6,347,962 | B1 | 2/2002 | Kline |
| 6,350,134 | B1 | 2/2002 | Fogg et al. |

6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,371,773 B1 4/2002 Crofoot et al.
6,375,478 B1 4/2002 Kikuchi
6,379,188 B1 4/2002 Cohen et al.
6,386,914 B1 5/2002 Collins et al.
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,528,737 B1 3/2003 Kwong et al.
6,530,134 B1 3/2003 Laphan et al.
6,537,086 B1 3/2003 MacMullin
6,537,111 B2 3/2003 Brammer et al.
6,540,522 B2 4/2003 Sipe
6,540,558 B1 4/2003 Paagman
6,540,559 B1 4/2003 Kemmick et al.
6,547,066 B2 4/2003 Koch
6,551,140 B2 4/2003 Billman et al.
6,554,647 B1 4/2003 Cohen et al.
6,565,388 B1 5/2003 Van Woensel et al.
6,572,409 B2 6/2003 Nitta et al.
6,572,410 B1 6/2003 Volstorf et al.
6,589,071 B1 7/2003 Lias et al.
6,592,381 B2 7/2003 Cohen et al.
6,607,402 B2 8/2003 Cohen et al.
6,633,490 B2 10/2003 Centola et al.
6,641,411 B1 11/2003 Stoddard et al.
6,641,825 B2 11/2003 Scholz et al.
6,652,318 B1 11/2003 Winings et al.
6,672,907 B2 1/2004 Azuma
6,692,272 B2 2/2004 Lemke et al.
6,695,627 B2 2/2004 Ortega et al.
6,712,646 B2 3/2004 Shindo
6,717,825 B2 4/2004 Volstorf
6,736,664 B2 5/2004 Ueda et al.
6,746,278 B2 6/2004 Nelson et al.
6,749,439 B1 6/2004 Potter et al.
6,762,067 B1 7/2004 Quinones et al.
6,764,341 B2 7/2004 Lappoehn
6,776,649 B2 8/2004 Pape et al.
6,786,771 B2 9/2004 Gailus
6,799,215 B1 9/2004 Giroir et al.
6,805,278 B1 10/2004 Olson et al.
6,808,399 B2 10/2004 Rothermel et al.
6,808,420 B2 10/2004 Whiteman, Jr. et al.
6,824,391 B2 11/2004 Mickiewvicz et al.
6,835,072 B2 12/2004 Simons et al.
6,843,686 B2 1/2005 Ohnishi et al.
6,848,944 B2 2/2005 Evans
6,851,974 B2 2/2005 Doutrich
6,851,980 B2 2/2005 Nelson et al.
6,852,567 B1 2/2005 Lee et al.
6,869,292 B2 3/2005 Johnescu et al.
6,872,085 B1 3/2005 Cohen et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,902,411 B2 6/2005 Kubo
6,913,490 B2 7/2005 Whiteman, Jr. et al.
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,969,280 B2 11/2005 Chien et al.
6,976,886 B2 12/2005 Winings et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,021,975 B2 4/2006 Lappohn
7,044,794 B2 5/2006 Consoli et al.
7,090,501 B1 8/2006 Scherer et al.
7,094,102 B2 8/2006 Cohen et al.
7,097,506 B2 8/2006 Nakada
7,101,191 B2 9/2006 Benham et al.
7,108,556 B2 9/2006 Cohen et al.
7,114,964 B2 10/2006 Winings et al.
7,118,391 B2 10/2006 Minich et al.
7,131,870 B2 11/2006 Whiteman, Jr. et al.
7,172,461 B2 2/2007 Davis et al.
7,207,807 B2 4/2007 Fogg
7,239,526 B1 7/2007 Bibee
7,241,168 B2 7/2007 Sakurai et al.
7,270,574 B1 9/2007 Ngo
7,281,950 B2 10/2007 Belopolsky
7,292,055 B2 11/2007 Egitto
7,322,855 B2 1/2008 Mongold et al.
7,331,802 B2 2/2008 Rothermel et al.
7,407,387 B2 8/2008 Johnescu
7,429,176 B2 9/2008 Johnescu
7,497,735 B2 3/2009 Belopolsky
7,497,736 B2 3/2009 Minich et al.
7,500,871 B2 3/2009 Minich et al.
7,553,182 B2 6/2009 Buck et al.
7,621,781 B2 11/2009 Rothermel et al.
7,762,843 B2 7/2010 Minich et al.
8,062,046 B2 * 11/2011 Daily et al. ..... 439/290
8,096,832 B2 1/2012 Minich et al.
2001/0012729 A1 8/2001 Van Woensel
2001/0046810 A1 11/2001 Cohen et al.
2002/0039857 A1 4/2002 Naito et al.
2002/0084105 A1 7/2002 Geng
2002/0098727 A1 7/2002 McNamara et al.
2002/0106930 A1 8/2002 Pape et al.
2002/0111068 A1 8/2002 Cohen et al.
2002/0127903 A1 9/2002 Billman et al.
2003/0116857 A1 6/2003 Taniguchi et al.
2003/0143894 A1 7/2003 Kline et al.
2003/0171010 A1 9/2003 Winings et al.
2003/0203665 A1 10/2003 Ohnishi et al.
2003/0220021 A1 11/2003 Whiteman, Jr. et al.
2004/0157477 A1 8/2004 Johnson et al.
2004/0161954 A1 8/2004 Johnescu et al.
2004/0224559 A1 11/2004 Nelson et al.
2004/0235321 A1 11/2004 Mizumura et al.
2005/0009402 A1 1/2005 Chien et al.
2005/0032401 A1 2/2005 Kobayashi
2005/0032437 A1 2/2005 Johnescu et al.
2005/0048838 A1 3/2005 Korsunsky et al.
2005/0079763 A1 4/2005 Lemke et al.
2005/0101188 A1 5/2005 Benham et al.
2005/0118869 A1 6/2005 Evans
2005/0148239 A1 7/2005 Hull et al.
2005/0164555 A1 * 7/2005 Winings et al. ..... 439/608
2005/0170700 A1 8/2005 Shuey et al.
2005/0196987 A1 9/2005 Shuey et al.
2005/0202722 A1 9/2005 Regnier et al.
2005/0215121 A1 9/2005 Tokunaga
2005/0227552 A1 10/2005 Yamashita et al.
2005/0277315 A1 12/2005 Mongold et al.
2005/0287869 A1 12/2005 Kenny et al.
2006/0014433 A1 1/2006 Consoli et al.
2006/0024983 A1 2/2006 Cohen et al.
2006/0024984 A1 2/2006 Cohen et al.
2006/0046526 A1 3/2006 Minich

| | | | |
|---|---|---|---|
| 2006/0051987 | A1 | 3/2006 | Goodman et al. |
| 2006/0068610 | A1 | 3/2006 | Belopolsky |
| 2006/0068641 | A1 | 3/2006 | Hull et al. |
| 2006/0073709 | A1 | 4/2006 | Reid |
| 2006/0116857 | A1 | 6/2006 | Sevic |
| 2006/0121749 | A1 | 6/2006 | Fogg |
| 2006/0192274 | A1 | 8/2006 | Lee et al. |
| 2006/0216969 | A1 | 9/2006 | Bright et al. |
| 2006/0228912 | A1 | 10/2006 | Morlion et al. |
| 2006/0232301 | A1 | 10/2006 | Morlion et al. |
| 2007/0004287 | A1 | 1/2007 | Marshall |
| 2007/0099455 | A1 | 5/2007 | Rothermel et al. |
| 2007/0205774 | A1 | 9/2007 | Minich |
| 2007/0207641 | A1 | 9/2007 | Minich |
| 2007/0287336 | A1 | 12/2007 | Buck et al. |
| 2008/0003880 | A1 | 1/2008 | Belopolsky |
| 2008/0045079 | A1 | 2/2008 | Minich et al. |
| 2008/0176453 | A1 | 7/2008 | Minich et al. |
| 2009/0159314 | A1 | 6/2009 | Minich et al. |
| 2010/0291806 | A1 | 11/2010 | Minich et al. |

FOREIGN PATENT DOCUMENTS

| | | | |
|---|---|---|---|
| EP | 0891016 | A1 | 1/1999 |
| EP | 1193799 | | 4/2002 |
| EP | 1148587 | B1 | 4/2005 |
| JP | 6236788 | A | 8/1994 |
| JP | 7114958 | | 5/1995 |
| JP | 11-185886 | A | 7/1999 |
| JP | 2000-003743 | A | 1/2000 |
| JP | 2000-003744 | A | 1/2000 |
| JP | 2000-003745 | A | 1/2000 |
| JP | 2000-003746 | A | 1/2000 |
| WO | WO 90/16093 | A1 | 12/1990 |
| WO | WO 01/29931 | A1 | 4/2001 |
| WO | WO 01/39332 | A1 | 5/2001 |
| WO | WO 02/101882 | A2 | 12/2002 |
| WO | WO 2006/020378 | | 2/2006 |
| WO | WO 2006/031296 | A | 3/2006 |
| WO | WO 2006/105535 | A1 | 10/2006 |
| WO | WO 2008/082548 | A1 | 7/2008 |

OTHER PUBLICATIONS

U.S. Appl. No. 60/870,791, filed Dec. 19, 2006, Minich.
U.S. Appl. No. 60/870,793, filed Dec. 19, 2006, Minich.
U.S. Appl. No. 60/870,796, filed Dec. 19, 2006, Minich.
U.S. Appl. No. 60/887,081, filed Jan. 29, 2007, Johnescu.
U.S. Appl. No. 60/917,491, filed May 11, 2007, Minich.
Supplemental European Search Report for EP 07863105, mailed Jun. 20, 2011.
"B? Bandwidth and Rise Time Budgets" Module 1-8 Fiber Optic Telecommunications (E-XVI-2a), http://cord.org/step_online/st1-8/stl8exvi2a.htm, 3 pages, date unavailable.
4.0 UHD Connector Differential Signal Crosstalk, Reflections, 1998, p. 8-9.
Airmax VS® High Speed Connector System, Communications Data, Consumer Division, 2004, 16 pages.
AMP Z-Pack 2mm HM Connector, 2 mm Centerline, Eight-Row, Right-Angle Applications, Electrical Performance Report, EPR 889065, Issued Sep. 1998, 59 pages.
AMP Z-Pack 2mm HM Interconnection System, 1992 and 1994 by AMP Incorporated, 6 pages.
AMP Z-Pack HM-ZD Performance at Gigabit Speeds, Tyco Electronics, Report #20GC014, Rev. B., May 4, 2001,30 pages.
Amphenol TCS (ATCS) Backplane Connectors, 2002, www.amphenol-tcs.com, 3 pages.
Amphenol TCS (ATCS): HDM® Stacker Signal Integrity, http://www.teradyne.com/prods/tcs/products/connectors/mezzanine/hdm_stacker/signintegr, 3 pages, date not available.
Amphenol TCS (ATCS): VHDM Connector, http://www.teradyne.com/prods/tcs/products/connectors/backplane/vhdm/index.html, 2 pages, date not available.
Amphenol TCS (ATCS): VHDM L-Series Connector, http://www.teradyne.com/prods.tcs/products/connectors/backplane/vhdm_1-series/index.html, 2006, 4 pages.
Amphenol TCS (ATCS)-Ventura® High Performance, Highest Density Available, 2002, www.amphenol_tcs.com, 2 pages.
Amphenol TCS (ATCS)-XCede® Connector, 2002, www.amphenol-tcs.com, 5 pages.
Backplane Products Overview Page, http://www.molex.com/cgi-bin/bv/volex/super_family/super_family.jsp?BV_SessionID=© 2005-2006, Molex, 4 pages.
Backplane Products, www.molex.com, 2007, 3 pages.
Communications, Data, Consumer Division Mezzanine High-Speed High-Density Connectors GIG-Array® and MEG-Array® Electrical Performance Data, FCI Corporation, 10 pages, date unavailable.
FCI's Airmax VS® Connector System Honored at DesignCon, 2005, Heilind Electronics, Inc., http://www.heilind.com/products/fci/airmax-vs-design.asp, 1 page.
Framatone Connector Specification, 1 page.
Fusi, M.A. et al., "Differential Signal transmission Through Backplanes and Connectors," Electronic Packaging and Production, Mar. 1996, 27-31.
GIG-Array® Connector System, Board to Board Connecctors, 2005, 4 pages.
GIG-Array® High Speed Mezzanine Connectors 15-40 mm Board-to-Board, Jun 5, 2006, 1 page.
Goel, R.P. et al., "AMP Z-Pack Interconnect System," 1990, AMP Incorporated, 9 pages.
HDM Separable Interface Detail, Molex®, 3 pages, date not available.
HDM/HDM Plus, 2mm, Backplane Interconnection System, Teradyne Connection Systems, © 1993, 22 pages.
HDM® HDM Plus® Connectors, http://www.teradyne.com/prods/tcs/products/connectors/backplane/hdm/index/html, 2006, 1 page.
Honda Connectors,"Honda High-Speed Backplane Connector NSP Series," Honda Tsushin Kogoyo Co., Ltd., Development Engineering Division, Tokyo, Japan, Feb. 7, 2003, 25 pages.
Hult, B., "FCI's Problem Solving Approach Changes Market, The FCI Electronics AirMax VS," ConnecctorSupplier.com, http://www.connectorsupplier.com/tech_updates_FCI-Airmax_archive.htm, 2006, 4 pages.
In The United States Patent and Trademark Office, In re U.S. Appl. No. 11/713,503, filed Mar. 2, 2007, Notice of Abandonment dated Sep. 11, 2009, 2 pages.
In The United States Patent and Trademark Office, In re U.S. Appl. No. 11/713,503, filed Mar. 2, 2007, Advisory Action dated May 5, 2009, 3 pages.
In The United States Patent and Trademark Office, In re U.S. Appl. No. 11/713,503, filed Mar. 2, 2007, Final Office Action dated Feb. 27, 2009, 4 pages.
In The United States Patent and Trademark Office, In re U.S. Appl. No. 11/713,503, filed Mar. 2, 2007, Non-Final Office Action dated Nov. 6, 2008, 4 pages.
In The United States Patent and Trademark Office, In re U.S. Appl. No. 11/713,503, filed Mar. 2, 2007, Notice of Publication dated Sep. 4, 2008, 1 page.
In The United States Patent and Trademark Office, In re U.S. Appl. No. 11/713,503, filed Mar. 2, 2007, Non-Final Office Action dated Jun. 20, 2008, 5 pages.
In The United States Patent and Trademark Office, In re U.S. Appl. No. 11/713,503, filed Mar. 2, 2007, Tyco Declaration under 37 1.132, 11 pages.
In The United States Patent and Trademark Office, In re U.S. Appl. No. 11/713,503, filed Mar. 2, 2007, Request for Consideration After Final dated Apr. 24, 2009, 5 pages.
In The United States Patent and Trademark Office, In re U.S. Appl. No. 11/713,503, filed Mar. 2, 2007, Response to Office Action dated Nov. 6, 2008, mailed Feb. 6, 2009, 5 pages.
In The United States Patent and Trademark Office, In re U.S. Appl. No. 11/713,503, filed Mar. 2, 2007, Response to Office Action dated Jun. 20, 2008, mailed Sep. 22, 2008, 4 pages.
International Search Report, International Application No. PCT/US2008/002569, Publication No. WO2008/108951, International Filing Date: Feb. 27, 2008, 3 pages.
Lucent Technologies Bell Labs and FCI Demonstrate 25 gb/Sdata Transmission over Electrical Backplane Connectors, Feb. 1, 2005, http://www.lucent.com/press/0205/050201.bla.html, 4 pages.

Metral™ 2mm High-Speed Connectors, 1000, 2000, 3000 Series, Electrical Performance Data for Differential Applications, FCI Framatone Group, 2 pages, date unavailable.
Metral™, "Speed & Density Extensions," FCI, Jun. 3, 1999, 25 pages.
Millipacs Connector Type A Specification, 1 page.
Molex Features and Specifications, www.molex.com/link/Impact.html, May 2008, 5 pages.
Molex Incorporated Drawings, 1.0 HDMI Right Angle Header Assembly (19 PIN) Lead Free, Jul. 20, 2004, 7 pages.
Molex, GbXI-Trac™ Backplane Connector System, www.molex.com/cgi-bin, 2007, 3 pages.
Molex, High Definition Multimedia Interface (HDMI) www.molex.com, 2 pages, date unavailable.
Nadolny, J. et al., "Optimizing Connector Selection for Gigabit Signal Speeds," ECN™, Sep. 1, 2000, http://www.ecnmag.com/article/CA45245, 6 pages.
NSP Honda The World Famous Connectors, http://www.honda-connectros.co.jp, 6 pages,English Language translation attached, date unavailable.
PCB-Mounted Receptacle Assemblies, 2.00 mm (0.079 in) Centerlines, Right-Angle Solder-to-Board Signal receptacle Metral™, Berg Electronics, 10-6-10-7, 2 pages.
Provisional Patent Application, Cohen, U.S. Appl. No. 60/584,928, filed Jul. 1, 2004.
Samtec, E.L.P. Extended Life Product, Open Pin Field Array Seaf Series, 2005, www.santec.com, 1 page.
Samtec, High Speed Characterization Report, SEAM-30-02 0-S-10-2 Mates With SEAF-30-05.0-S-10-2, Open Pin Field Array, 1.27 mm×1.27 mm Pitch 7mm Stack Height 2005, www.samtec.com, 51 pages.
TB-2127, "VENTURA™ Application Design," Revision, General Release, Specification Revision Status-B, Hurisaker, Aug. 25, 2005, Amphenol corporation 2006, 1-13.
Teradyne Connection Systems, Inc., Customer Use Drawing No. C-163-5101-500, Rev. 04, date not available.
Tyco Electornics Z-Dok+ Connector, May 23, 2003, http://zdok.tycoelectronics.com, 15 pages.
Tyco Electronics Engineering Drawing, Impact, 3 Pair 10 Column Signal Module, Mar. 25, 2008, 1 page.
Tyco Electronics Engineering Drawing, Impact, 3 Pair Header Unguided Open Assembly, Apr. 11, 2008, 1 page.
Tyco Electronics, High Speed Backplane Interconnect Solutions, Feb. 7, 2003, 6 pages.
Tyco Electronics, Impact™ Connector Offered by Tyco Electronics, High Speed Backplane Connector System, Apr. 15, 2008, 12 pages.
Tyco Electronics, Overview for High Density Backplane Connector (Z-Pack TinMan), 2005, 1 page.
Tyco Electronics, Overview for High Density Backplane Connectors (Impact™) Offered by Tyco Elecctronics, www.tycoelectronics.com/catalog, 2007, 2 pages.
Tyco Electronics, Two-Piece, High-Speed Connectors, www.tycoelectronics.com/catalog, 2007, 3 pages.
Tyco Electronics, Z-Dok and Connector, Tyco Electronics, Jun. 23, 2003, http://2dok.tyco.electronics.com, 15 pages.
Tyco Electronics, Z-Pack Slim UHD, http:/ww.zpackuhd.com, 2005, 8 pages.
Tyco Electronics, Z-Pack TinMan Prod Portfolio, 2005, 1 page.
Tyco Electronics, Z-Pack TinMan, Product Portfolio Expanded to Include 6-Pair Module, 2005, 1 page.
Tyco Electronics/AMP, "Champ Z-Dok Connector System," Catalog #1309281, Issued Jan. 2002, 3 pages.
Tyco Electronics/AMP, "Z-Dok and Z-Dok and Connectors," Application Specification #114-13068, Aug. 30, 2005, Revision A, 16 pages.
Tyco Unveils Z-Pack TinMan Orthogonal Connector System, http://www.epn-online.com/page/new59327/tyco-unveils-z-pack-orthogonal-conn, Oct. 13, 2009, 4 pages.
VHDM Daughterboard Connectors Feature press-fit Terminations and a Non-Stubbing Separable Interface, © Teradyne, Inc., Connections Systems Division, Oct. 8, 1997, 46 pages.
VHDM High-Speed Differential (VHDM HSD), http://www.teradyne.com/prods/bps/vhdm/hsd.html, 6 pages.
Z-Pack TinMan High Speed Orthogonal Connector Product Feature Selector, http://catalog.tycoelectronics.com/catalog/feat/en/s/24643?BML=10576.17560.17759, Oct. 13, 2009, 2 pages.

* cited by examiner

SHIELDLESS, HIGH-SPEED, LOW-CROSS-TALK ELECTRICAL CONNECTOR

CROSS-REFERENCE TO RELATED APPLICATIONS

This application is a continuation application of U.S. patent application Ser. No. 12/843,735, filed Jul. 26, 2010, now U.S. Pat. No. 8,096,832, which is a continuation application of U.S. patent application Ser. No. 12/396,086, filed Mar. 2, 2009, now U.S. Pat. No. 7,762,843, which is a divisional application of U.S. patent application Ser. No. 11/958,098, filed Dec. 17, 2007, now U.S. Pat. No. 7,497,736, which is a continuation-in-part of U.S. patent application Ser. No. 11/726,936, filed Mar. 23, 2007, now U.S. Pat. No. 7,503,804, and which also claims the benefit under 35 U.S.C. §119(e) of provisional U.S. patent application Nos. 60/870,791, filed Dec. 19, 2006, 60/870,793, filed Dec. 19, 2006, 60/870,796, filed Dec. 19, 2006, 60/887,081, filed Jan. 29, 2007, and 60/917,491, filed May 11, 2007. The disclosure of each of the above-referenced U.S. patent applications is incorporated by reference as if set forth in its entirety herein.

This application is related to U.S. patent application Ser. No. 10/953,749 filed Sep. 29, 2004, now issued as U.S. Pat. No. 7,281,950; U.S. patent application Ser. No. 11/388,549 filed Mar. 24, 2006, published as U.S. Publication No. 2006/0228912; U.S. patent application Ser. No. 11/855,339 filed Sep. 14, 2007, now U.S. Pat. No. 7,497,735; U.S. patent application Ser. No. 11/837,847 filed Aug. 13, 2007, now U.S. Pat. No. 7,500,871; and U.S. patent application Ser. No. 11/450,606 filed Jun. 9, 2006, now U.S. Pat. No. 7,553,182.

BACKGROUND

Electrical connectors provide signal connections between electronic devices using electrically-conductive contacts. In some applications, an electrical connector provides a connectable interface between one or more substrates, e.g., printed circuit boards. Such an electrical connector may include a header connector mounted to a first substrate and a complementary receptacle connector mounted to a second substrate. Typically, a first plurality of contacts in the header connector are adapted to mate with a corresponding plurality of contacts in a receptacle connector.

Undesirable electrical signal interference between differential signal pairs of electrical contacts increases as signal density increases, particularly in electrical connectors that are devoid of metallic crosstalk shields. Signal density is important because silicon chips are subject to heat constraints as clock speeds increase. One way to achieve more signal throughput, despite the limitations of silicon-based chips, is to operate several chips and their respective transmission paths in parallel at the same time. This solution requires more backpanel, midplane, and daughter card space allocated to electrical connectors.

Therefore, there is a need for an orthogonal differential signal electrical connector with balanced mating characteristics that occupies a minimum amount of substrate space yet still operates above four Gigabits/sec with six percent or less of worst case, multi-active crosstalk in the absence of metallic crosstalk shields.

SUMMARY

An electrical connector may include a plurality of electrically isolated electrical contacts arranged at least partially coincident along a common centerline, wherein at least two of the plurality of electrically isolated electrical contacts each define a mating end that deflects in a first direction transverse to the common centerline by corresponding blade contacts of a mating connector. At least one of the plurality of electrically isolated electrical contacts is adjacent to one of the at least two of the plurality of electrically isolated electrical contacts and defines a respective mating end that deflects in a second direction transverse to the common centerline and opposite to the first direction by a corresponding blade contact of the mating connector. At least one of the plurality of electrically isolated electrical contacts may include two adjacent electrically isolated electrical contacts. At least two of the plurality of electrically isolated electrical contacts may be adjacent to each other and the at least two of the plurality of electrically isolated electrical contacts may each deflect in the first direction. The at least one of the plurality of electrically isolated electrical contacts may include two adjacent electrically isolated electrical contacts. The at least two of the plurality of electrically isolated electrical contacts may include at least three electrically isolated electrical contacts that are adjacent to each other and that each define a mating end that deflects in a first direction transverse to the common centerline by corresponding blade contacts of a mating connector. The at least one of the plurality of electrically isolated electrical contacts could also include three adjacent electrically isolated electrical contacts. The at least two of the plurality of electrically isolated electrical contacts may include at least four electrically isolated electrical contacts that are adjacent to each other and that each define a mating end that deflects in a first direction transverse to the common centerline by corresponding blade contacts of a mating connector. The at least one of the plurality of electrically isolated electrical contacts may include four adjacent electrically isolated electrical contacts.

An electrical connector may also include an array of electrical contacts with adjacent electrical contacts in the array paired into differential signal pairs along respective centerlines. The differential signal pairs may be separated from each other along the respective centerlines by a ground contact, wherein the electrical connector is devoid of metallic plates and comprises more than eighty-two differential signal pairs per inch of card edge, one of the more than eighty-two differential signal pairs is a victim differential signal pair, and differential signals with rise times of 70 picoseconds in eight aggressor differential signal pairs closest in distance to the victim differential signal pair produce no more than six percent worst-case, multi-active cross talk on the victim differential signal pair. The adjacent electrical contacts that define a differential signal pair may be separated by a first distance and the differential signal pair may be separated from the ground contact by a second distance that is greater than the first distance. The second distance may be approximately 1.5 times greater than the first distance, two times greater than the first distance, or greater than two times greater than the first distance. Each electrical contact in the array of electrical contacts may include a receptacle mating portion. The receptacle mating portions in the array of electrical contacts may be circumscribed within an imaginary perimeter of about 400 square millimeters or less. Each electrical contact in the array of electrical contacts may include a receptacle compliant portion and the receptacle compliant portions in the array of electrical contacts may be circumscribed within an imaginary perimeter of about 400 square millimeters or less. The electrical connector may extend no more than 20 mm from a mounting surface of a substrate. A pitch may be defined between each of the centerlines of the contacts arranged in the first direction. The pitch between each of the centerlines may be approximately 1.2 mm to 1.8 mm.

An electrical connector may include a first electrical contact and a second electrical contact positioned at least partially along a first centerline. The first electrical contact may be adjacent to the second electrical contact, wherein the first electrical contact defines a tail end that jogs in a first direction away from the first centerline. The second electrical contact defines a tail end that jogs in a second direction opposite the first direction. A third electrical contact and a fourth electrical contact may be positioned at least partially along a second centerline that is adjacent to the first centerline. The third electrical contact may be adjacent to the fourth electrical contact, wherein the third electrical contact defines a tail end that jogs in a second direction and the fourth electrical contact defines a tail end that jogs in the first direction. The tail ends of the first and second electrical contacts may be in an orientation that is the mirror image of the tail ends of the third and fourth electrical contacts. The first and second electrical contacts may form a differential signal pair, and the third and fourth electrical contacts may form a differential signal pair. The electrical connector may further comprise a ground contact adjacent to the second electrical contact along the first centerline.

A substrate may include a first electrical via and a second electrical via positioned at least partially along a first centerline. The first electrical via may be adjacent to the second electrical via. The first electrical via may jog in a first direction away from the first centerline and the second electrical via may jog in a second direction opposite the first direction. A third electrical via and a fourth electrical via may be positioned at least partially along a second centerline that is adjacent to the first centerline. The third electrical via may be adjacent to the fourth electrical via. The third electrical via may jog in a second direction and the fourth electrical via may jog in the first direction. The first and second electrical vias are preferably in an orientation that is a mirror image of third and fourth electrical vias.

An electrical connector may comprise a differential signal pair comprising a first electrical contact retained in a dielectric housing and a second electrical contact retained in the housing adjacent to the first signal contact, wherein the first electrical contact has a first length in the first direction, the second signal contact has a second length in the first direction, the first length being less than the second length, and an electrical signal in the second signal contact propagates through the second length longer than the electrical signal in the first signal contact propagates through the first length to correct skew from a mating differential signal pair in a mating right angle connector.

An electrical connector may include an array of right-angle electrical contacts with adjacent electrical contacts in the array paired into differential signal pairs along respective centerlines. The differential signal pairs may be separated from each other along the respective centerlines by a ground contact. The electrical connector may be devoid of metallic plates and may comprise a differential signal pair density that can be calculated by varying the disclosed X and Y direction spacings. For example, in the disclosed 1 mm Y direction pitch, 25.4 contacts fit in a one inch Y direction. In a signal-signal-ground configuration, this yields eight differential signal pairs in the Y direction. At a corresponding 1 mm X direction pitch, 25.4 centerlines fit within a one inch X direction. Eight differential pairs times 25.4 contact centerlines equals 203 differential signal pairs. Other differential signal pair densities can be calculated in the same way be substituting the disclosed X and Y dimensions.

DETAILED DESCRIPTION

Figure 1A:
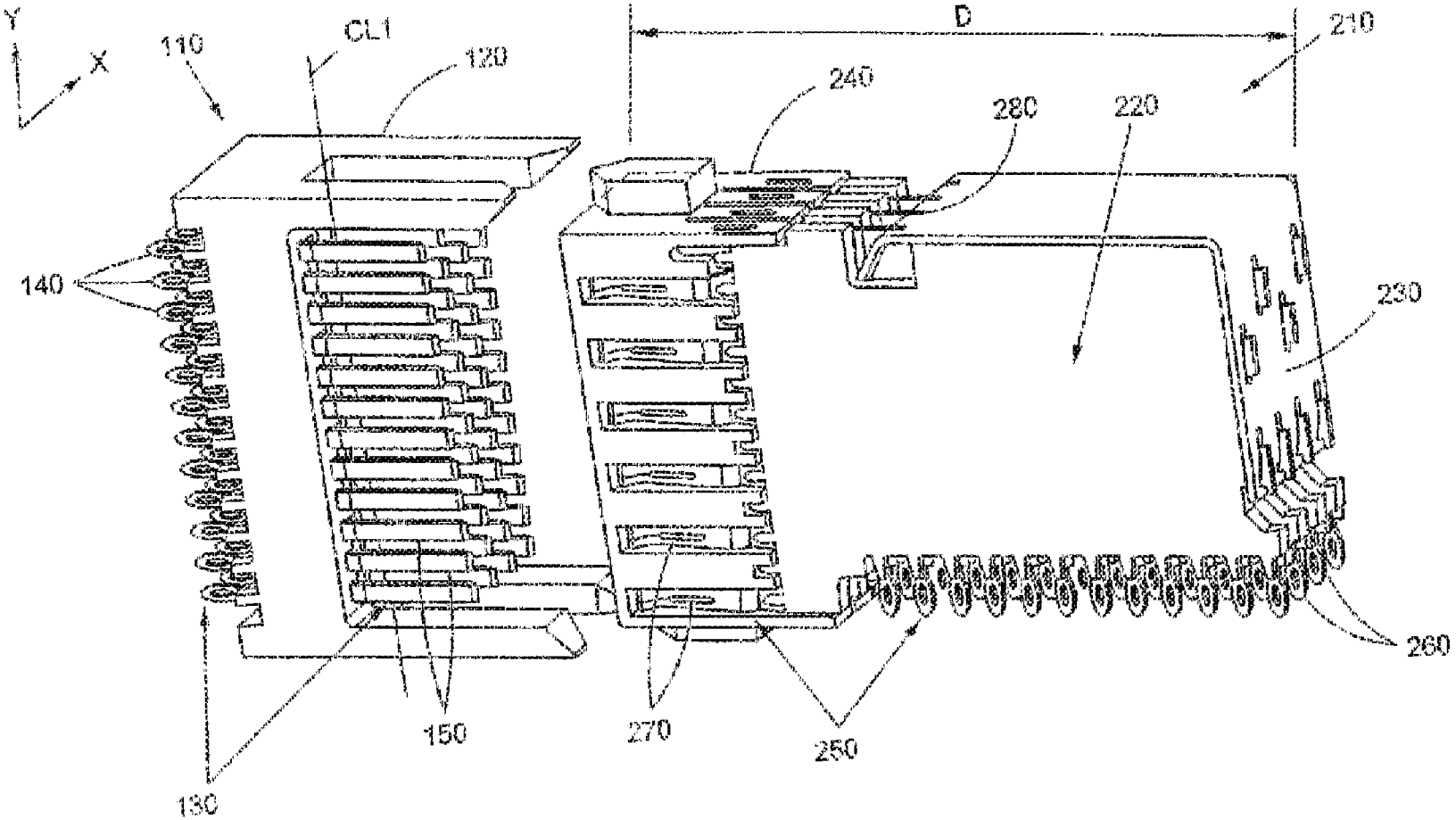
FIGS. 1A and 1B depict a vertical header connector and right-angle receptacle connector.
Figure 1B:
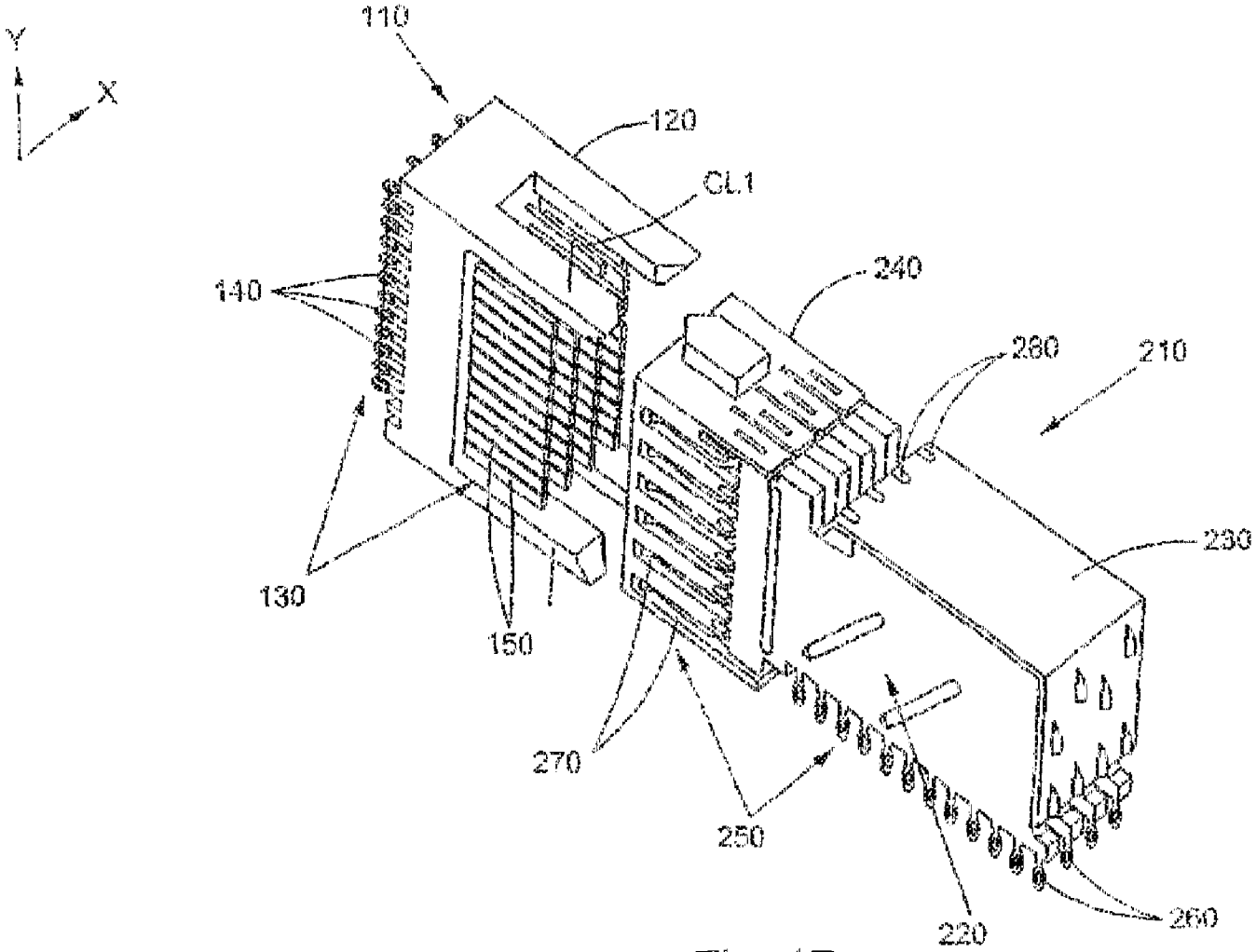

FIGS. 1A and 1B depict a first electrical connector 110 and a second electrical connector 210. As shown, the first electrical connector 110 may be a vertical header connector. That is, the first electrical connector 110 may define mating and mounting regions that are parallel to one another. The second electrical connector 210 may be a right-angle connector, or some other suitable mating connector that mates with first electrical connector 110. That is, the second electrical connector 210 may define mating and mounting regions that are perpendicular to one another. Though the embodiments depicted herein show a vertical header connector and a right-angle receptacle connector, it should be understood that either the first or second electrical connectors 110, 210 could be a vertical connector or a right-angle connector, either the first or second electrical connectors 110, 210 could be a header connector or a receptacle connector, and both of the first and second electrical connectors 110, 210 can be mezzanine connectors.

The first and second electrical connectors 110 and 210 may be shieldless high-speed electrical connectors, i.e., connectors that operate without metallic crosstalk plates at data transfer rates at or above four Gigabits/sec, and typically anywhere at or between 6.25 through 12.5 Gigabits/sec or more (about 80 through 35 picosecond rise times) with acceptable worst-case, multi-active crosstalk on a victim pair of no more than six percent. Worst case, multi-active crosstalk may be determined by the sum of the absolute values of six or eight aggressor differential signal pairs (FIG. 3) that are closest to the victim differential signal pair. Rise time≈0.35/bandwidth, where bandwidth is approximately equal to one-half of the data transfer rate. Each differential signal pair may have a differential impedance of approximately 85 to 100 Ohms, plus or minus 10 percent. The differential impedance may be matched to the impedance of a system, such as a printed circuit board or integrated circuit, for example, to which the connectors may be attached. The connectors 110 and 210 may have an insertion loss of approximately −1 dB or less up to about a five-Gigahertz operating frequency and of approximately −2 dB or less up to about a ten-Gigahertz operating frequency.

Referring again to FIGS. 1A and 1B, the first electrical connector 110 may include a header housing 120 that carries electrical contacts 130. The electrical contacts 130 include a header mating portion 150 and a header compliant portion 140. Each of the header mating portions 150 may define a respective first broadside and a respective second broadside opposite the first broadside. Header compliant portions 140 may be press-fit tails, surface mount tails, or fusible elements such as solder balls. The electrical contacts 130 may be insert molded prior to attachment to the header housing 120 or stitched into the header housing 120. Each of the electrical contacts 130 may have a material thickness approximately equal to its respective height, although the height may be greater than the material thickness. For example, the electrical contacts 130 may have a material thickness of about 0.1 mm to 0.45 mm and a contact height of about 0.1 mm to 0.9 mm. In an edge coupled arrangement along centerline CL1, the adjacent electrical contacts 130 that define a differential signal pair may be equally spaced or unevenly spaced from an adjacent ground contact. For example, the spacing between a first differential signal contact and a second adjacent differential signal contact may be approximately 1.2 to 4 times less than the spacing between the second differential signal contact and an adjacent ground contact. As shown in FIG. 1D, a uniform X-direction centerline pitch CL1, CL2, CL3 of about 1 mm to 2 mm is desired and an approximate 1 mm to 1.5 mm Y-direction centerline pitch CLA, CLB is desired, with 1.2 mm, 1.3 mm, or 1.4 mm preferred. The spacing between adjacent electrical contacts 130 may correspond to the dielectric material between the electrical contacts 130. For example, electrical contacts 130 may be spaced more closely to one another where the dielectric material is air, than they might be where the dielectric material is a plastic.

With continuing reference to FIGS. 1A and 1B, second electrical connector 210 includes insert molded leadframe assemblies (IMLA) 220 that are carried by a receptacle housing 240. Each IMLA 220 carries electrical contacts, such as right angle electrical contacts 250. Any suitable dielectric material, such as air or plastic, may be used to isolate the right angle electrical contacts 250 from one another. The right angle electrical contacts 250 include a receptacle mating portion 270 and a receptacle compliant portion 260. The receptacle compliant portions 260 may be similar to the header compliant portions 140 and may include press-fit tails, surface mount tails, or fusible elements such as solder balls. The right angle electrical contacts 250 may have a material thickness of about 0.1 mm to 0.5 mm and a contact height of about 0.1 mm to 0.9 mm. The contact height may vary over the overall length of the right angle electrical contacts 250, such that the mating ends 280 of the right angle electrical contacts 250 have a height of about 0.9 mm and an adjacent lead portion 255 (FIG. 14) narrows to a height of about 0.2 mm. In general, a ratio of mating end 280 height to lead portion 255 (FIG. 14) height may be about five. The second electrical connector 210 also may include an IMLA organizer 230 that may be electrically insulated or electrically conductive. An electrically conductive IMLA organizer 230 may be electrically connected to electrically conductive portions of the IMLAs 220 via slits 280 defined in the IMLA organizer 230 or any other suitable connection.

The first and second electrical connectors 110, 210 in FIGS. 1A and 1B may include four differential signal pairs and interleaved ground contacts positioned edge-to-edge along centerline CL1. However, any number of differential signal pairs can extend along centerline CL1. For example, two, three, four, five, six, or more differential signal pairs are possible, with or without interleaved ground contacts. A differential signal pair positioned along a centerline adjacent to centerline CL1 may be offset from a differential signal pair positioned along centerline CL2. Referring again to FIG. 1A, second electrical connector 210 has a depth D of less than 46 mm, preferably about 35 mm, when the second electrical connector 210 includes IMLAs 220 having eighteen right angle electrical contacts 250.

Figure 1C:
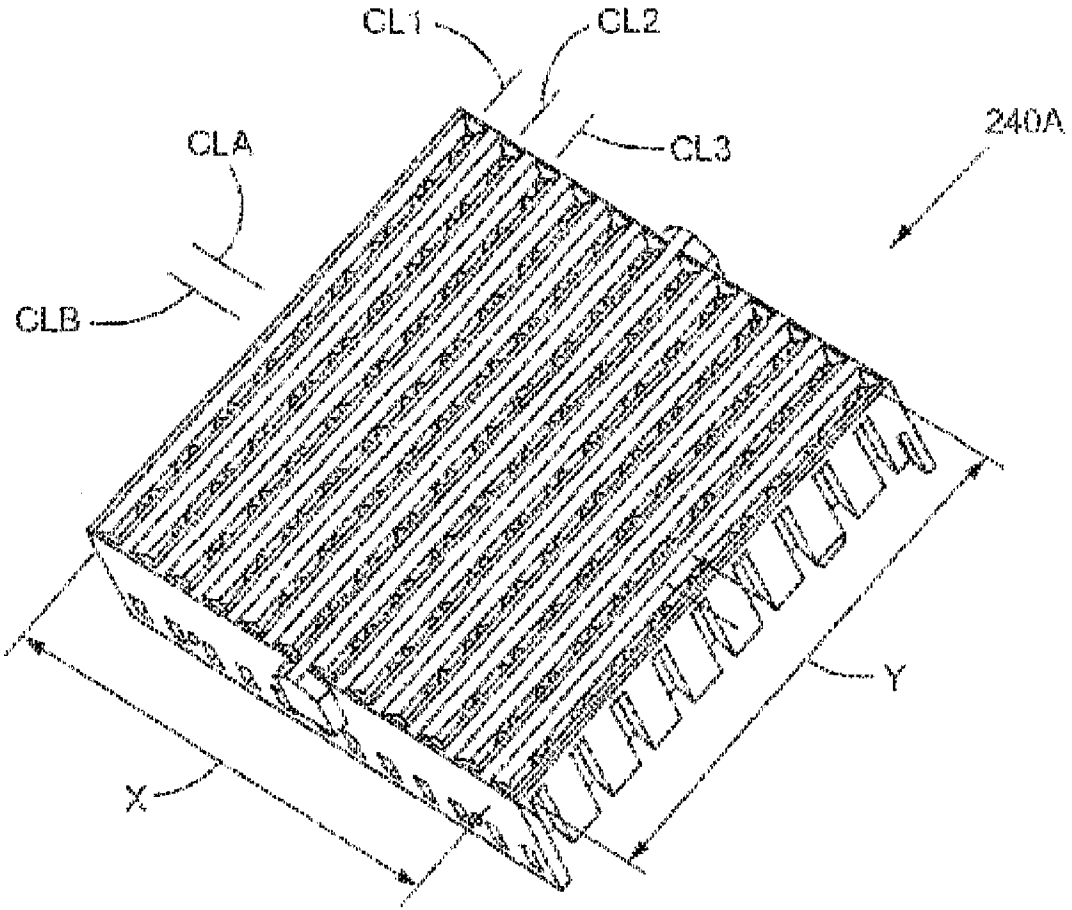
FIG. 1C depicts a right angle receptacle housing that accepts receptacle insert molded leadframe assemblies (IMLA) with six differential signal pairs and related ground contacts per centerline.
Figure 1D:
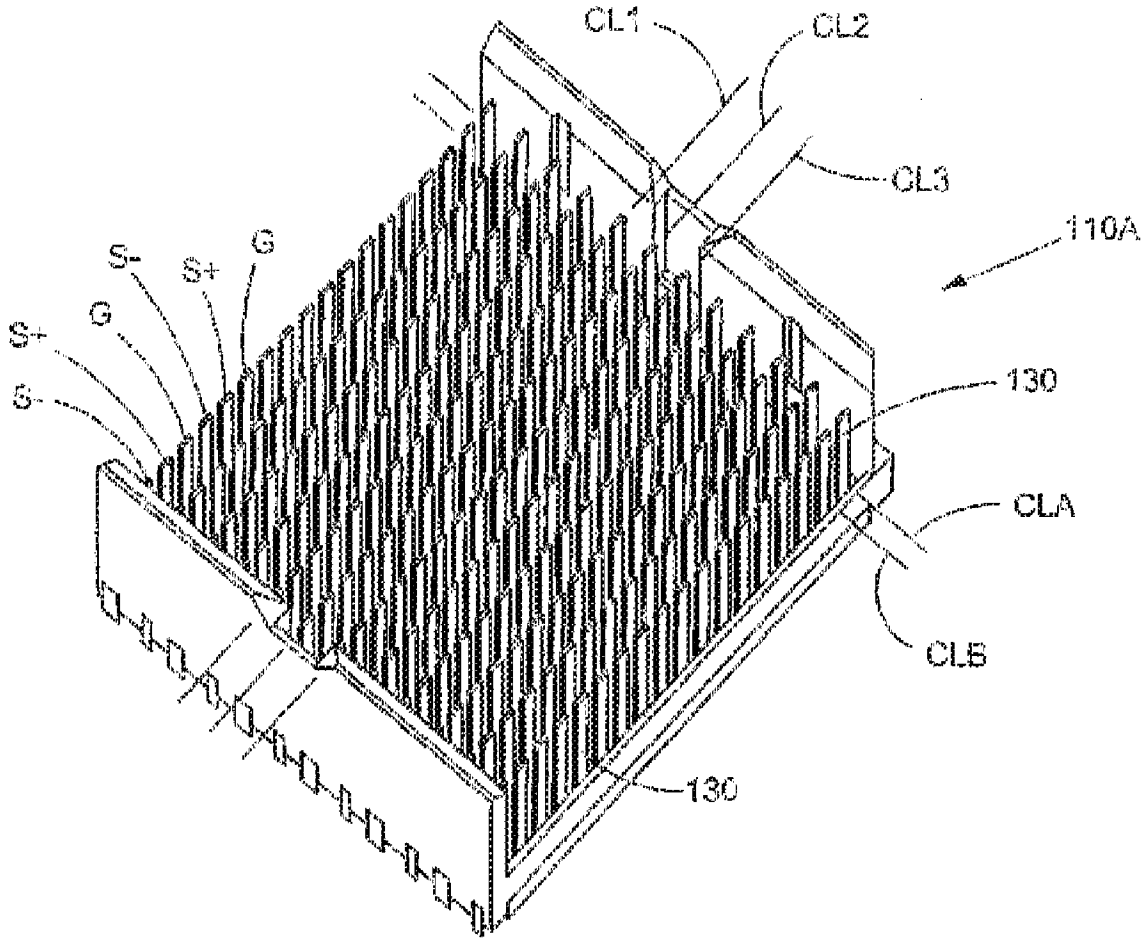
FIG. 1D depicts a vertical header connector with six differential signal pairs and related ground contacts per centerline.

FIG. 1C depicts a receptacle housing 240A that is configured to receive twelve IMLAs 220 (FIGS. 6A, 6B), each having six differential pairs and interleaved ground contacts positioned edge-to-edge along a common respective centerline CL1, CL2, CL3. This is approximately eighteen right angle electrical contacts per IMLA, with six right angle electrical contacts individually positioned/interleaved between the differential signal pairs dedicated to ground. In this embodiment, the differential signal pairs and interleaved ground contacts of each IMLA extend along respective centerlines CL1, CL2, CL3, etc. in the Y direction and the centerlines CL1, CL2, CL3 are spaced apart in the X direction. A receptacle mating region is defined by all of the receptacle mating portions 270 (FIG. 1A) that populate the X by Y area when the IMLAs are attached to the receptacle header 240A. The centerline spacing between differential pairs on centerlines CL1, CL2, and CL3 may be about 1 mm to 4 mm, with 1.5 mm or 1.8 mm centerline spacing preferred.

With continuing reference to FIG. 1C, the receptacle mating region of a second electrical connector 210 configured with twelve IMLAs 220 each comprising six differential pairs and interleaved ground contacts positioned edge-to-edge is approximately 20 mm to 25 mm in length in the X direction by approximately 20 mm to 27 mm in length in the Y direction. For example, a 20 mm by 20 mm receptacle mating region in this embodiment includes approximately two hundred and sixteen individual receptacle mating portions which can be paired into about seventy-two differential signal pairs. The number of differential signal pairs per inch of card edge, measured in the X direction, may be approximately eighty-four to eighty-five (more than eighty-two) when the differential signal pairs are on 1.8 mm centerlines CL1, CL2, CL3 and approximately 101 to 102 when the differential signal pairs are on 1.5 mm centerlines CL1, CL2, CL3. The height or Y direction length and the depth D (FIG. 1A) preferably stays constant regardless of the centerline spacing or the total number of IMLAs added or omitted.

FIG. 1D shows a first electrical connector 110A with electrical contacts 130 arranged into six differential signal pairs S+, S− and interleaved ground contacts G per centerline CL1, CL2, CL3. First electrical connector 110A can mate with the receptacle housing 240A shown in FIG. 1C.

Figure 2:
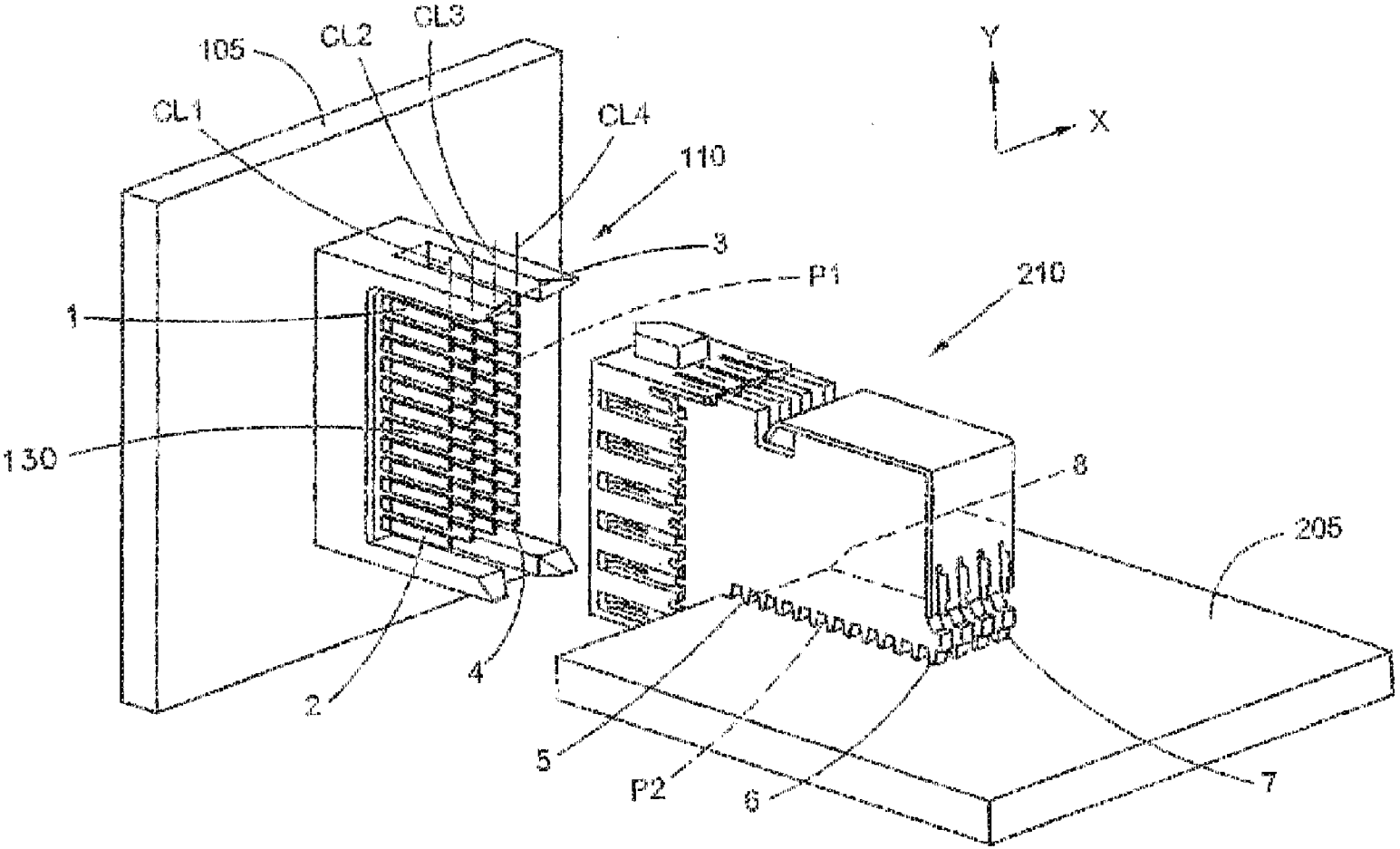
FIG. 2 depicts a vertical header connector and right-angle receptacle connector mounted to respective substrates.

As shown in FIG. 2, a header mating region the first electrical connector 110 is defined by an imaginary square or rectangular perimeter P1 that intersects electrical contacts 1, 2, 3, 4 and includes the header mating portions 150 circumscribed by imaginary perimeter P1. Although four centerlines CL1, CL2, CL3, CL4 of twelve contacts are shown in FIG. 2, for a total of four differential signal pairs and four interleaved ground contacts per centerline, the header mating region can be expanded in total area by adding more centerlines of electrical contacts or more electrical contacts 130 in the Y direction. For four differential signal pairs and interleaved ground contacts per centerline, the number of differential signal pairs per inch of card edge or X direction is approximately fifty-six at a 1.8 mm centerline spacing and approximately sixty-eight at a 1.5 mm centerline spacing. The card pitch between daughter cards stacked in series on a back panel or midplane is less than 25 mm, and is preferably about 18 mm or less. For five differential signal pairs and interleaved ground contacts per centerline, the number of differential signal pairs per inch of card edge X is approximately seventy-one differential signal pairs at a 1.8 mm centerline spacing and approximately eighty-five pairs at a 1.5 mm centerline spacing. The card pitch is less than 25 mm, and is preferably about 21 mm. For six differential signal pairs and interleaved ground contacts per centerline, the number of differential signal pairs per inch is the same as discussed above. The card pitch is less than 35 mm, and is preferably about 25 mm or less. An electrical connector with three differential signal pairs and interleaved grounds per centerline fits within a 15 mm card pitch.

In general, the card pitch increases by about 3 mm for each differential signal pair and adjacent ground contact added along a respective centerline in the Y direction and decreases by roughly the same amount when a differential signal pair and adjacent ground contact are omitted. Differential signal pairs per inch of card edge increases by about fourteen to seventeen differential signal pairs for every differential signal pair added to the centerline or omitted from the centerline, assuming the centerline spacing and the number of centerlines remain constant.

With continuing reference to FIG. 2, a receptacle footprint of the second electrical connector 210 is defined by an imaginary square or rectangular perimeter P2 that passes through receptacle compliant portion tails 5, 6, 7, and 8 and circumscribes receptacle compliant portions 260 within the P2 perimeter. The receptacle footprint of the second electrical connector is preferably about 20 mm by 20 mm for a six differential signal pair connector. A non-orthogonal header footprint of a mating six pair first electrical connector 110 is also preferably about 20 mm by 20 mm. As shown in FIG. 2, the first electrical connector 110 may be mounted to a first substrate 105 such as a backplane or midplane. The second electrical connector 210 may be mounted to a second substrate 205 such as a daughter card.

Figure 3:
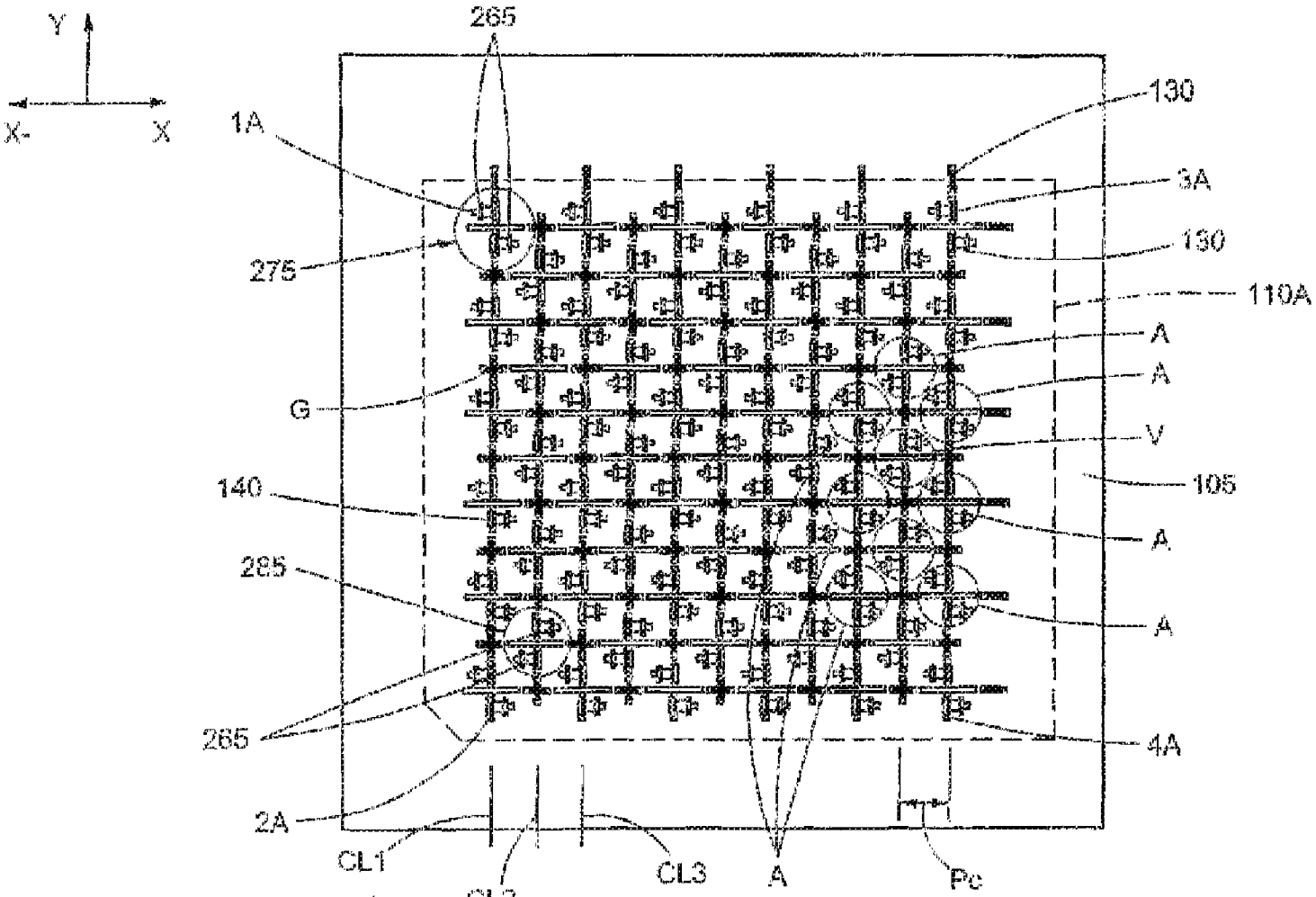
FIG. 3 depicts an orthogonal connector footprint and electrical contacts positioned on the orthogonal footprint.

FIG. 3 is a front view of a connector and corresponding via footprint, such as the first electrical connector 110A (FIG. 1D) mounted onto the first substrate 105. The header housing 120 hidden in FIG. 3 for clarity. The first electrical connector 110A includes electrical contacts 130 arranged along centerlines, as described above and each header compliant portion 140 may include a respective tail portion 265. However, the header compliant portions 140 and the corresponding footprint on the first substrate 105 are both arranged for shared via orthogonal mounting through the first substrate 105, such as a backplane or midplane. Tail portions 265 of a differential signal pair 275 and the corresponding substrate via may jog in opposite directions with respect to one another. That is, one tail portion and via of the differential signal pair 275 may jog in the X direction, and a second tail portion and via of a second contact of the differential signal pair 275 may jog in the X-direction. The ground contacts G adjacent to the differential signal pair may or may not jog with respect to the centerline CL1.

More specifically, the tail portions 265 of the differential signal pairs 275 positioned along centerline CL1 may have a tail and corresponding via orientation that is reversed from the tail and corresponding via orientation of tail portions 265 of differential signal pairs 285 positioned along an adjacent centerline CL2. Thus, the tail portion 265 and corresponding via of a first contact of a first differential signal pair 275 positioned along first centerline CL1 may jog in the X− direction. A tail portion 265 and corresponding via of a corresponding first contact of a second differential signal pair 285 in a second centerline CL2 may jog in the X direction. Further, the tail portion 265 and corresponding via of a second contact of the first differential signal pair 275 positioned along the first centerline CL1 may jog in the X direction, and a tail portion 265 and corresponding via of a second contact of the second differential signal pair 285 in the second centerline may jog in the X-direction. Thus, the tail portions 265 and respective vias positioned along a first centerline CL1 may jog in a pattern reverse to the pattern of the tail portions 265 and respective vias of the terminal ends of contacts positioned along centerline CL2. This pattern can repeat for the remaining centerlines.

The substrate via footprint and corresponding first electrical connector 110A shown in FIG. 3 provides for at least six differential signal pairs 275, 285 positioned along each of the eleven centerlines CL1, CL2, CL3, etc. Each of the centerlines additionally may include respective ground contacts/vias G disposed between signal pairs of the centerline. The substrate may define a centerline pitch Pc between adjacent centerlines CL1, CL2. The centerline pitch Pc of the substrate may be one and a half times the via or electrical contact 130 spacing within a respective centerline, for example. The first electrical connector 110 and vias preferably have a square or rectangular footprint defined by an imaginary perimeter P3 that passes through 1A, 1B, 1C, 1D and circumscribes the header compliant portions 140 or interior vias. Differential signal pairs A can be possible aggressor pairs and differential signal pair V can be a possible victim differential signal pair.

Figure 4B:
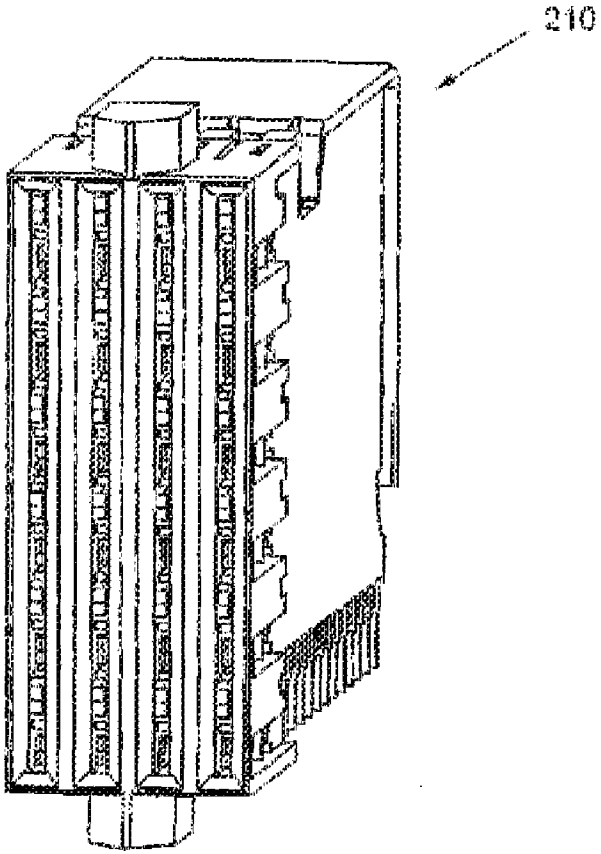
FIGS. 4A and 4B are front and isometric views, respectively, of a right-angle receptacle connector with a receptacle housing.
Figure 4A:
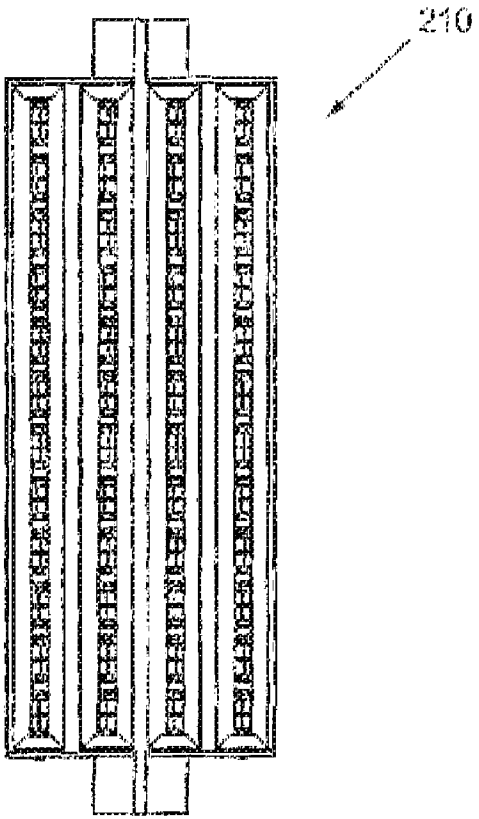

FIGS. 4A and 4B are front views of the second electrical connector 210 shown in FIGS. 1A and 1B.

Figure 5B:
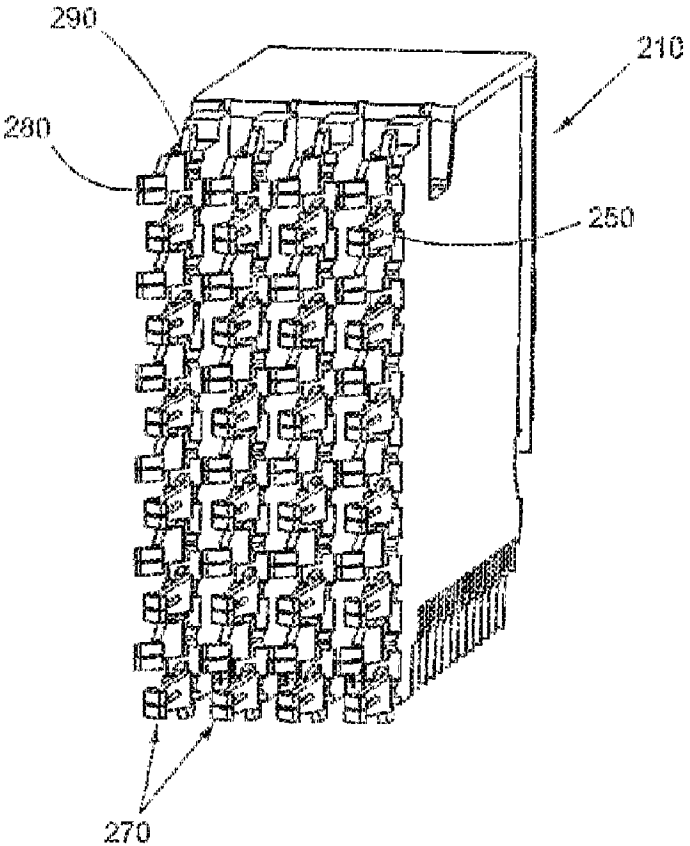
FIGS. 5A and 5B are front and isometric views, respectively, of a right-angle receptacle connector without a receptacle housing.
Figure 5A:
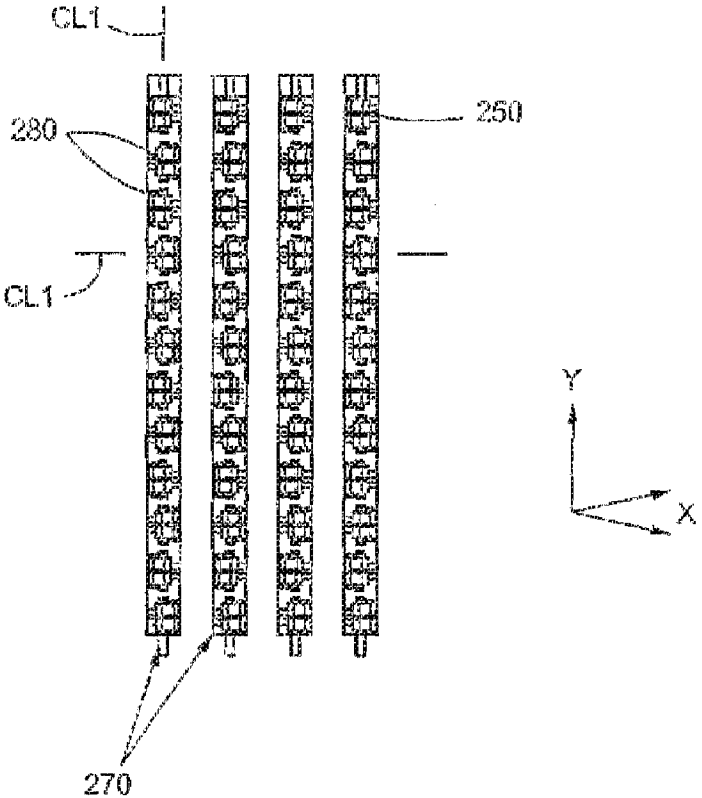

FIGS. 5A and 5B are front and isometric views, respectively, of the second electrical connector 210 shown in FIGS. 1A and 1B without the receptacle housing 240. As best seen without the receptacle housing 240, the receptacle mating portions 270 of the right angle electrical contacts 250 may define lead portions 290 and mating ends 280. The mating ends 280 may be offset from the centerline CL1 to fully accept respective header mating portions 150 of electrical contacts 130. That is, each mating end 280 may be offset in a direction that is perpendicular to the direction along which the centerline CL1 extends. Alternate mating ends 280 may be offset in alternating directions. That is, mating end 280 of a first one of the right angle electrical contacts 250 may be offset from centerline CL1 in a first direction that is perpendicular to centerline CL1, and the mating end 280 of an adjacent right angle electrical contact 250 positioned along the same centerline CL1 may be offset from the centerline CL1 in a second direction that is opposite the first direction. The mating ends 280 may bend toward the centerline CL1. Thus, the mating ends 280 of the right angle electrical contacts 250 may be adapted to engage blade-shaped header mating portions 150 (FIG. 1) of the first electrical contacts 130 from the first electrical connector 110, which, as described above, may be aligned along a centerline coincident with the centerline CL1 shown in FIG. 5A.

Figure 6A:
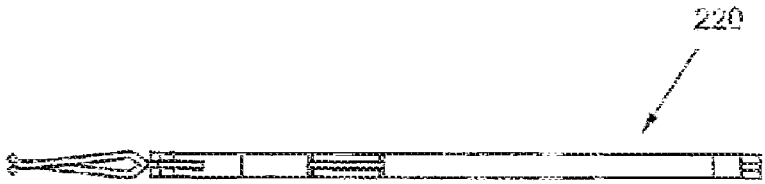
FIGS. 6A and 6B are top and side views, respectively, of a four differential signal pair IMLA for a right-angle receptacle connector.
Figure 6B:
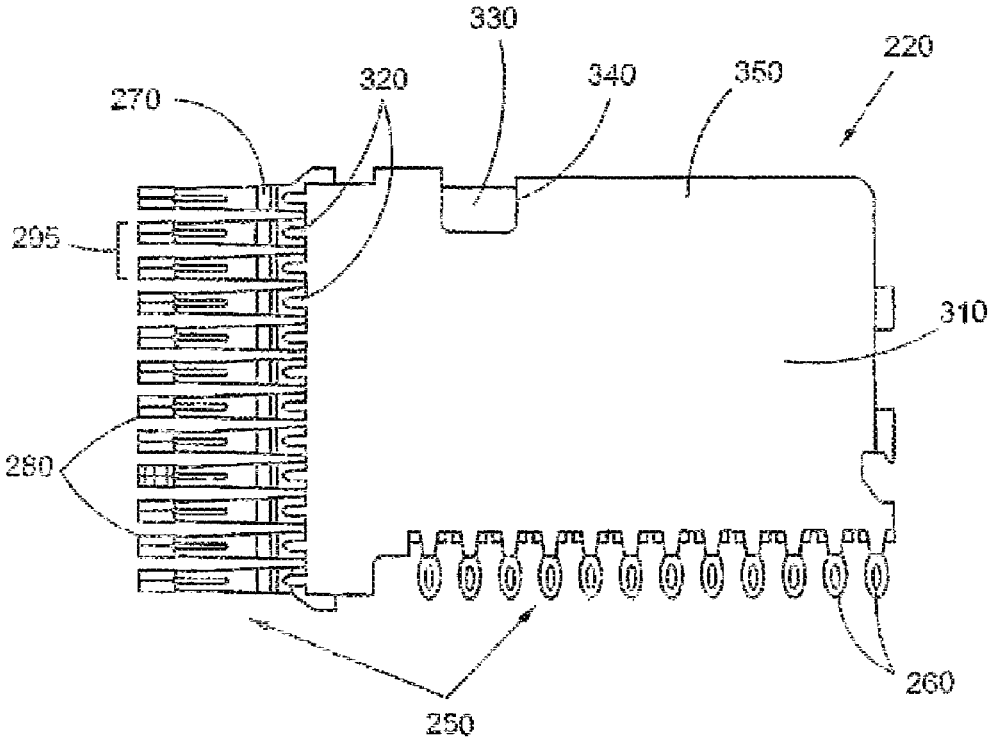

FIGS. 6A and 6B are top and side views, respectively, of an IMLA 220. As shown in FIG. 6B, each leadframe contact 250 may define a lead portion 255 (FIG. 14) that extends between the receptacle mating portion 270 and the receptacle compliant portions 260. The right angle electrical contacts 250 may define one or more angles. Ideally, lengths of the right angle electrical contacts 250 that form a differential signal pair 295 should vary by about 2 mm or less so that the signal skew is less than 10 picoseconds. IMLAs 220 may also include a respective tab 330 that may be defined in a recess 340 in plastic dielectric material 301 or otherwise exposed. For example, the dielectric material 310 may have a respective top surface 350 thereof. The recess 340 may be defined in the top surface 350 of the dielectric material 310 such that the tab 330 is exposed in the recess 340.

Figure 7B:
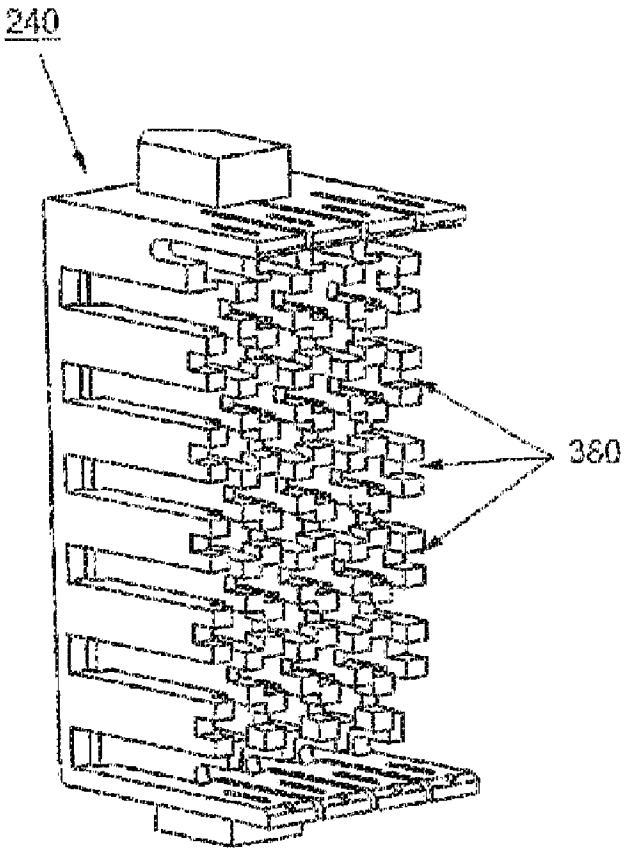
FIGS. 7A and 7B are front and isometric views, respectively, of a receptacle housing.

As shown in FIG. 6B, the dielectric material 310 may include one or more protrusions 320. Each protrusion 320 may be an optional keying feature that extends from the dielectric material 310 in a direction in which the IMLA 220 is received into a cavity 380 (FIG. 7B) the receptacle housing 240 (FIG. 7B). It should be understood that the IMLA 220 could have cavities that accept protrusions similar to protrusions 320 that extend from the receptacle housing 240 to minimize relative motion perpendicular to the mating direction.

Figure 7A:
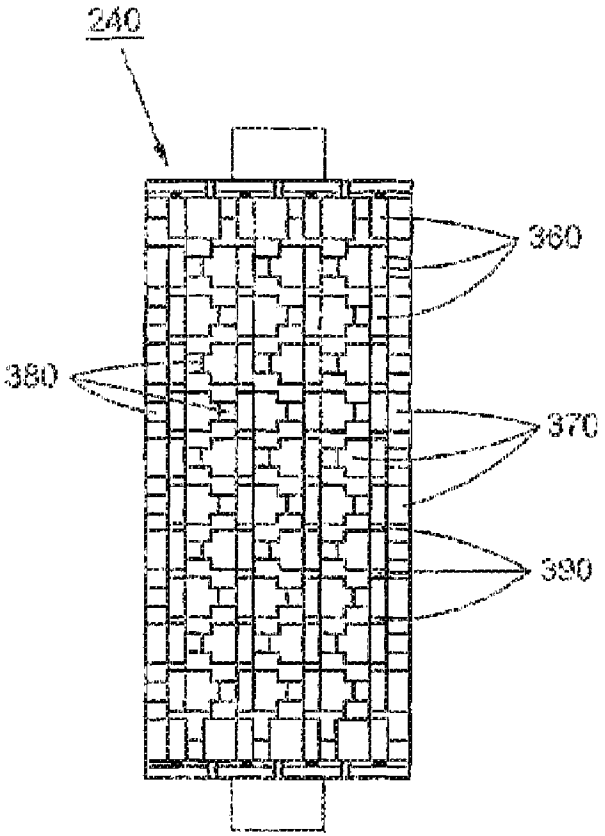
Figure 8B:
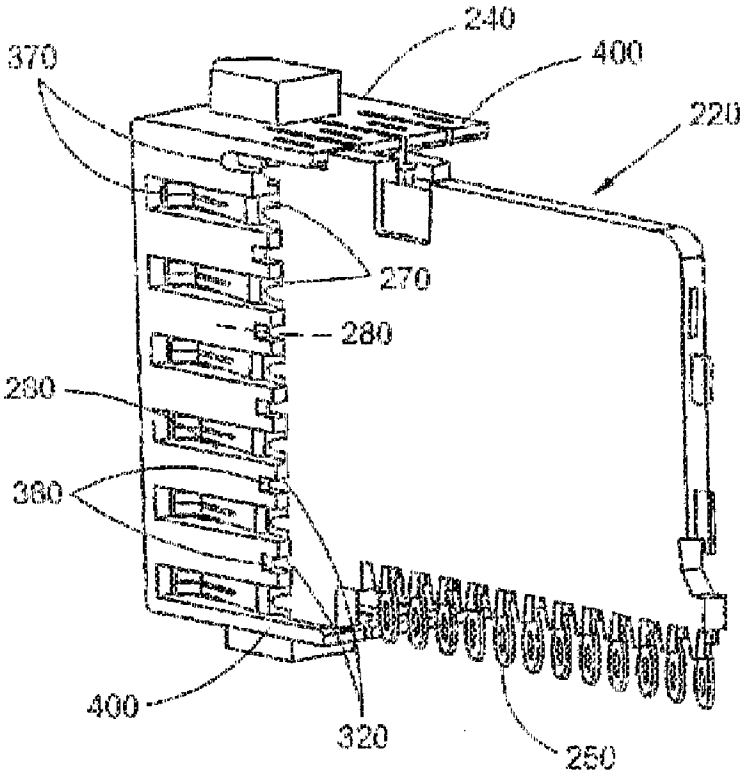
FIGS. 8A and 8B depict an IMLA being received into a receptacle housing.
Figure 8A:
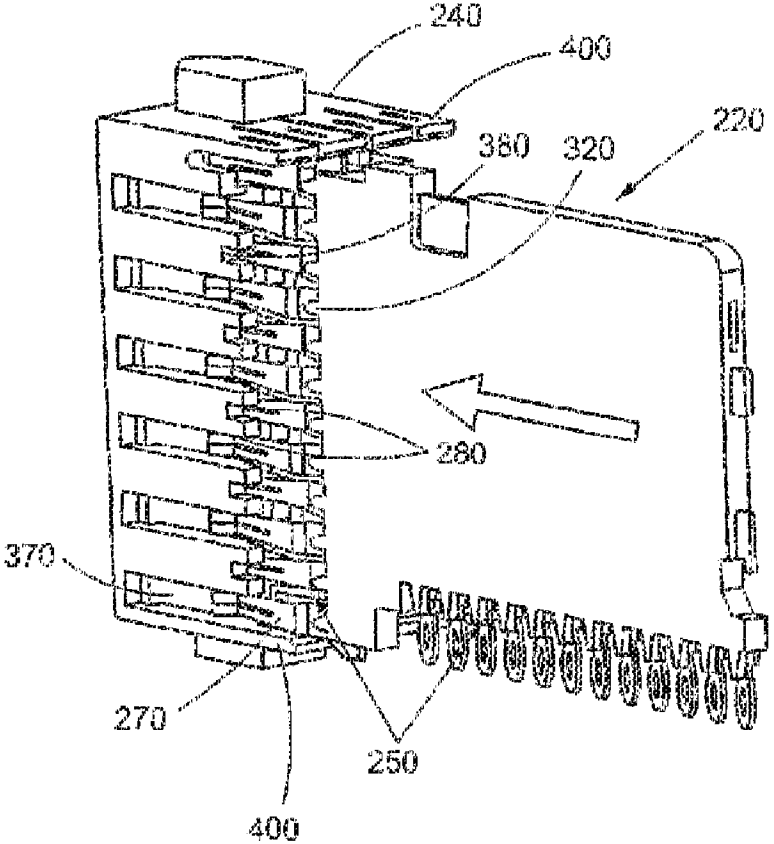

FIGS. 7A and 7B are front and isometric views, respectively, of the receptacle housing 240. As shown in FIG. 9A, the receptacle housing 240 may define one or more mating windows 360, one or more mating cavities 370, and one or more cavities 380. The receptacle housing 240 may further include walls 390 that separate adjacent right angle electrical contacts 250 (FIG. 1A) along a centerline to prevent electrical shorting. Each of the mating windows 360 may receive, as shown in FIG. 8A, a blade-shaped header mating portion 150 of a corresponding first electrical contact 130 from the first electrical connector 110 when the first electrical connector 110 and the second electrical connector 210 are mated.

Referring again to FIGS. 8A and 8B, a receptacle mating portion 270 of a corresponding right angle electrical contact 250 from the second electrical connector 210 (FIG. 1A) may extend into each of the mating cavities 370 and may pre-load the offset mating ends 280. The mating cavities 370 may be offset from one another to accommodate the offset mating ends 280 of right angle electrical contacts 250. Each of the cavities 380 may receive a respective protrusion 320 (FIG. 6B). The receptacle housing 240 may include latches 400 to secure the IMLAs 220, shown in FIGS. 6A and 6B, into the receptacle housing 240.

A plurality of IMLAs 220 may be arranged in the receptacle housing 240 such that each of the IMLAs 220 is adjacent to another IMLA 220 on at least one side. For example, the mating portions 270 of the right angle electrical contacts 250 may be received into the mating cavities 370. The IMLAs 220 may be received into the mating cavities 370 until each of the respective protrusions 320 is inserted into a corresponding cavity 380. The IMLA organizer 230 (FIG. 9) may then be assembled to the IMLAs 220 to complete the assembly of the second electrical connector 210.

Figure 9:
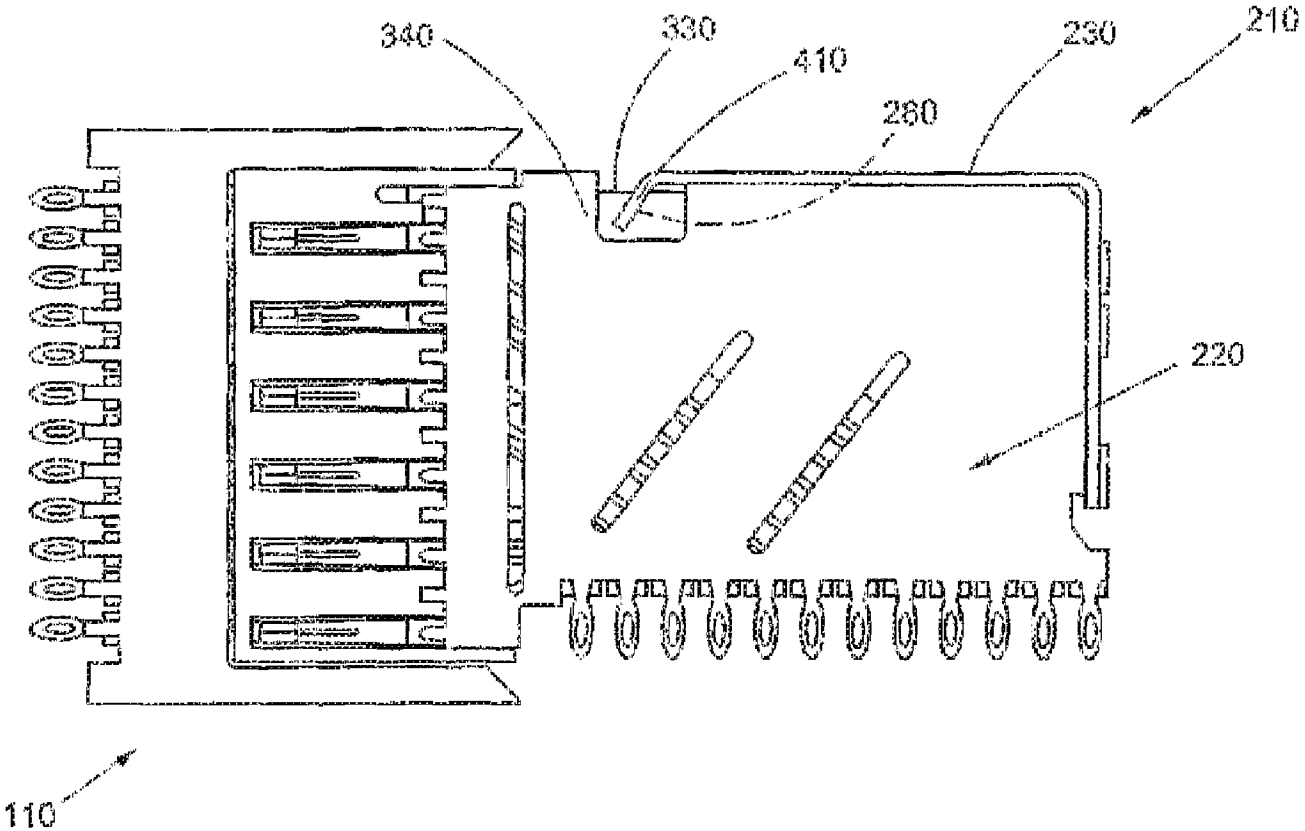
FIG. 9 is a side view of the mated electrical connectors depicted in FIGS. 1A and 1B.

FIG. 9 is a side view of the mated electrical first and second electrical connectors 110, 210 shown in FIGS. 1A and 1B. As shown, each of the respective slots 280 that may be defined in a curved portion 410 of the IMLA organizer 230 may receive a respective tab 330 from the recess 340 in IMLAs 220. For example, each of the tabs 330 may define a first side and a second side opposite of the first side.

FIGS. 10A-15B depict an array of first electrical contacts 130 mating and receptacle mating portions 270 of right angle electrical contacts 250. Each of the blade-shaped header mating portions 150 of the first electrical contacts 130 from the first electrical connector 110 (FIG. 1A) may mate with a corresponding mating end 280 of a right angle electrical contact 250 IMLA 220 from the second electrical connector 210 (FIG. 1A). Each of the mating ends 280 may contact a respective header mating portion 150 in at least one place, and preferably at least two places.

Figure 10B:
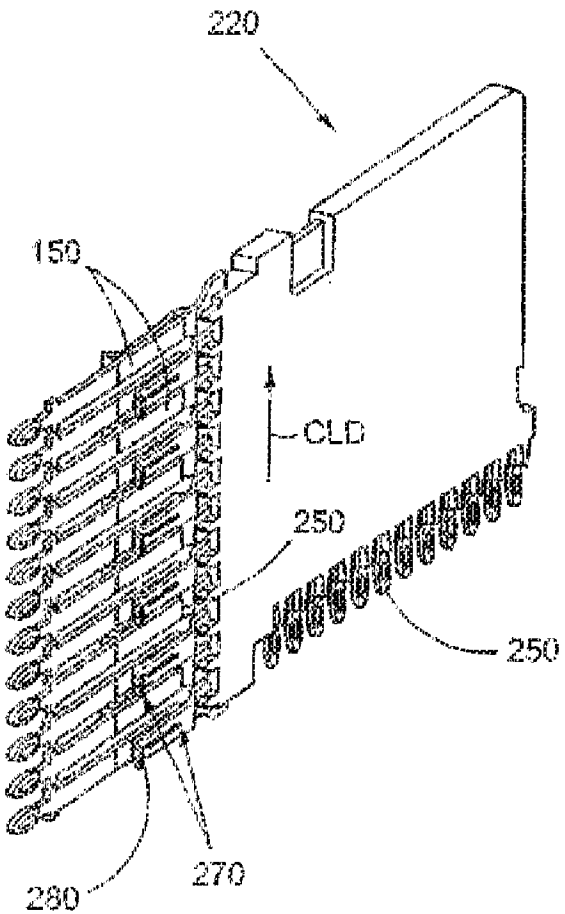
FIGS. 10A and 10B depict an array of electrical contacts mating with a first embodiment receptacle IMLA.
Figure 10A:
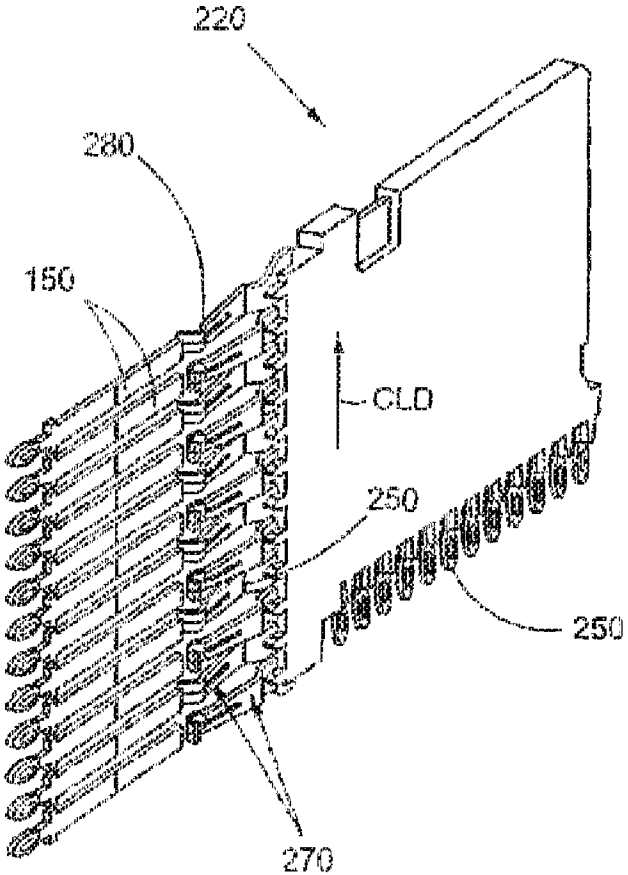

As shown in FIGS. 10A and 10B, the first broadsides of the blade-shaped header mounting portions 150 of the first electrical contacts 130 may define a first plane in a centerline direction CLD. The second broadsides of the blade-shaped header mounting portions 150 of the first electrical contacts 130 may define a second plane that may be offset from and parallel to the first plane. Some of the mating ends 280 of the receptacle mating portions 270 may physically contact the first broadside of a corresponding blade-shaped header mating portion 150, but not second broadside of the same blade-shaped header mating portion 150. The other mating ends 280 may physically contact the second broadside of a corresponding header mating portion 150, but not the first opposed broadside. Thus, a more balanced net force may be produced when the first and second electrical connectors 110, 210 are mated.

Figure 11B:
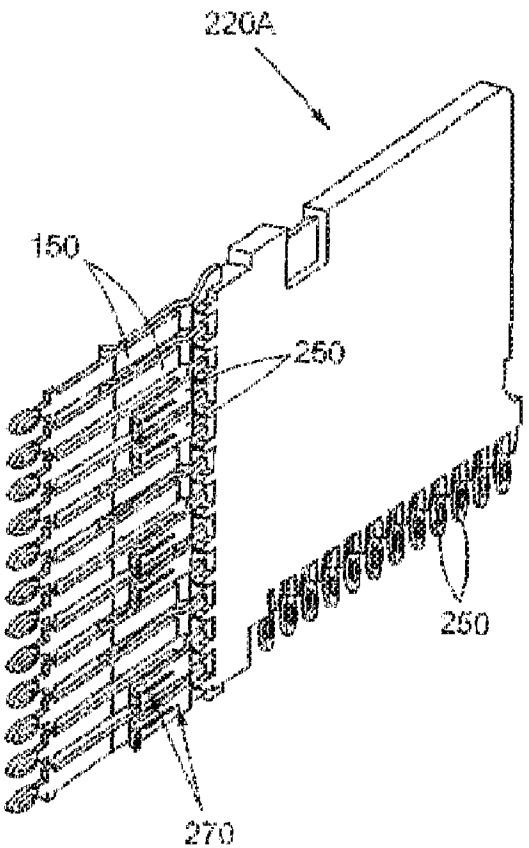
FIGS. 11A and 11B depict an array of electrical contacts mating with a second embodiment receptacle IMLA.
Figure 11A:
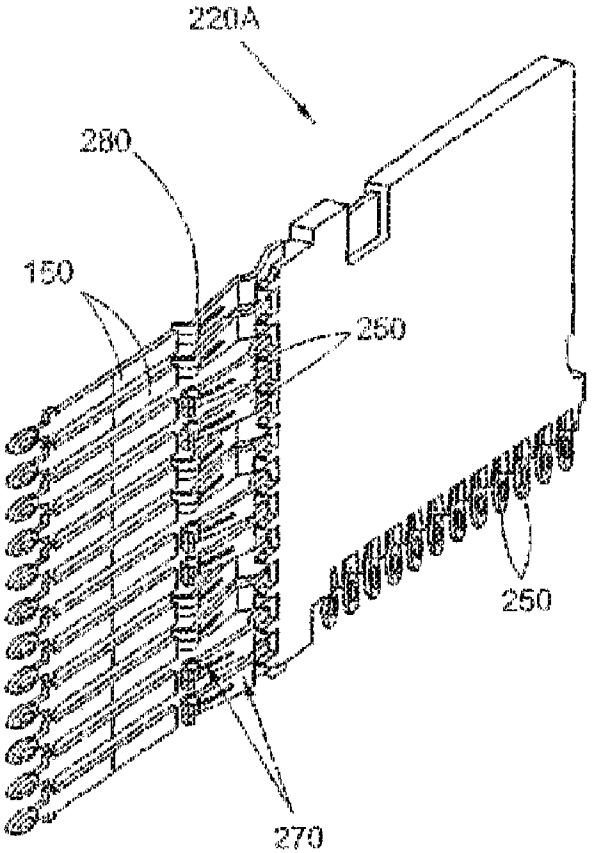

FIGS. 11A and 11B are similar to FIGS. 10A and 10B. The IMLA 220A carries right angle electrical contacts 250. However, in this embodiment two adjacent mating ends 280 contact a respective first broadside of two adjacent header mating portions 150 and two other adjacent mating ends 280 contact a respective second broadside of two other adjacent header mating portions 150.

Figure 12B:
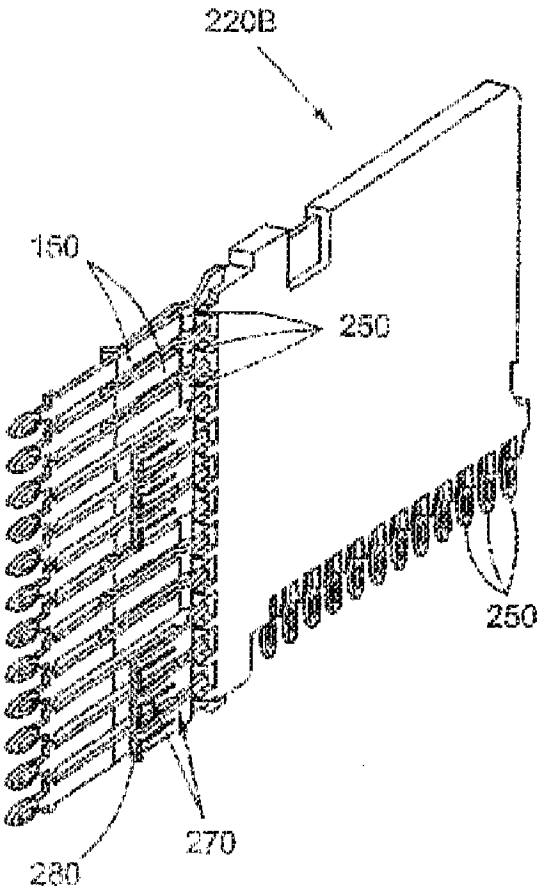
FIGS. 12A and 12B depict an array of electrical contacts mating with a third embodiment receptacle IMLA.
Figure 12A:
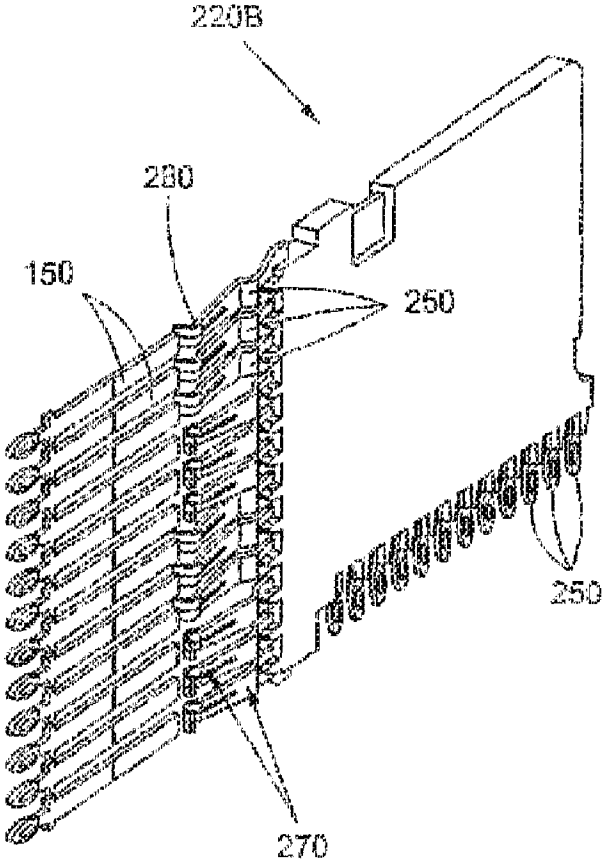

FIGS. 12A and 12B are similar to FIGS. 10A and 10B. The IMLA 220B carries right angle electrical contacts 250. However, in this embodiment three adjacent mating ends 280 contact a respective first broadside of three adjacent header mating portions 150 and three other adjacent mating ends 280 contact a respective second broadside of three other adjacent header mating portions 150.

Figure 13B:
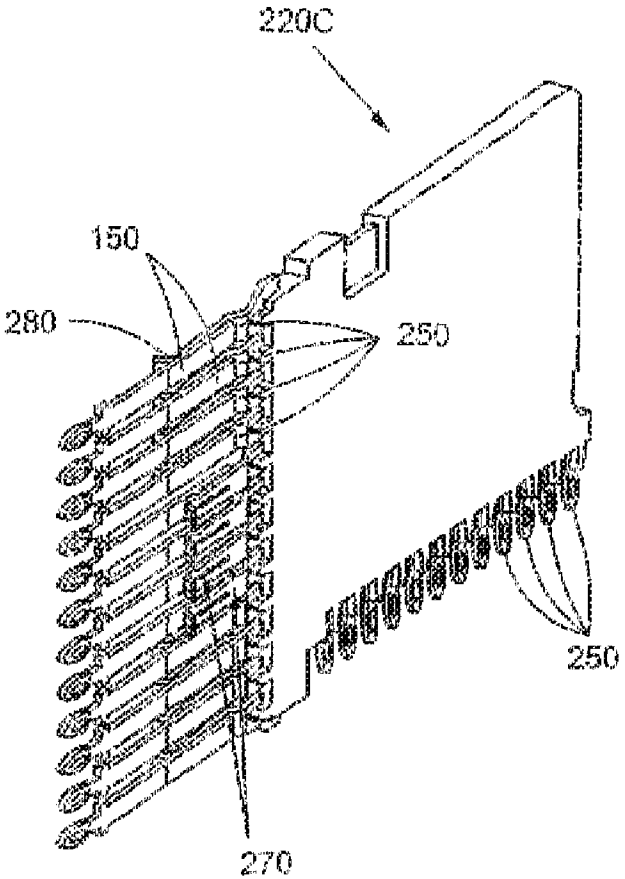
FIGS. 13A and 13B depict an array of electrical contacts mating with a fourth embodiment receptacle IMLA.
Figure 13A:
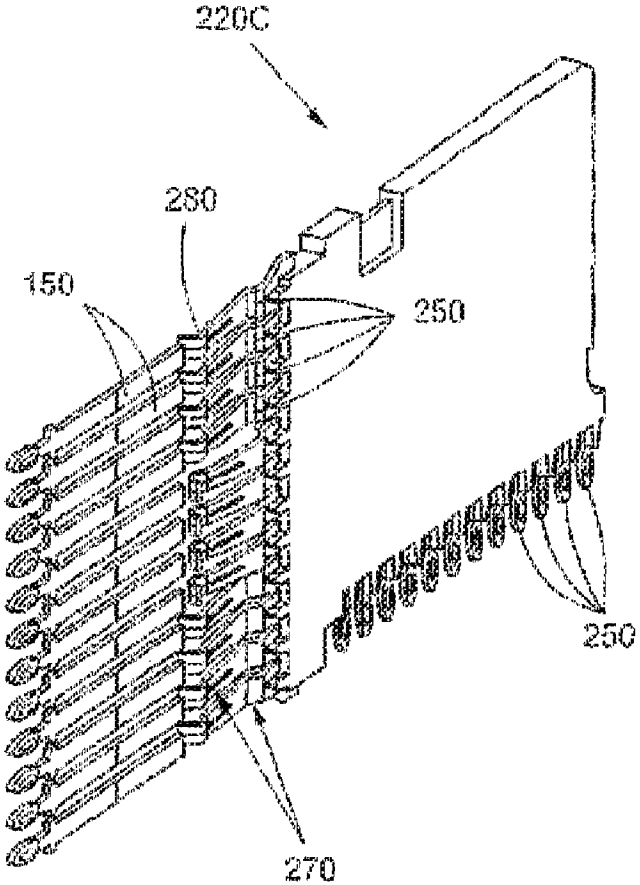

FIGS. 13A and 13B are similar to FIGS. 10A and 10B. The IMLA 220C carries right angle electrical contacts 250. However, in this embodiment four adjacent mating ends 280 contact a respective first broadside of four adjacent header mating portions 150 and four other adjacent mating ends 280 contact a respective second broadside of four other adjacent header mating portions 150.

It should be understood that although FIGS. 10A through 13B embodiments show adjacent mating ends 280 physically contacting opposite broadsides of corresponding header mating portions 150 the header mating portions 150.

Figure 14:
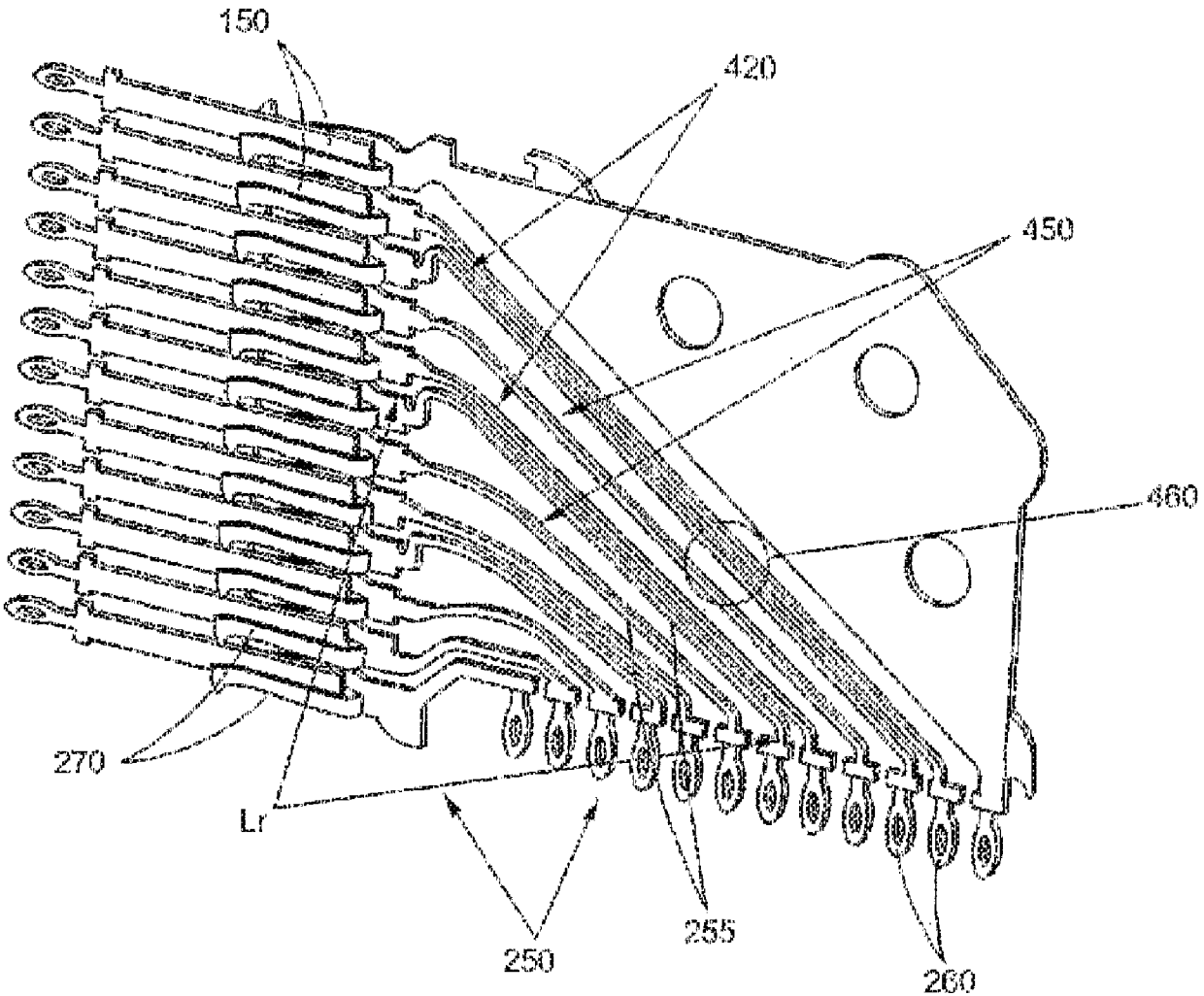
FIG. 14 depicts a mated right angle receptacle IMLA with plastic dielectric material removed.

FIG. 14 shows a plurality of right angle electrical contacts 250 with plastic dielectric material removed for clarity. The right angle electrical contacts 250 may include a plurality of differential signal pairs 420 and one or more electrically-conductive ground contacts 450. Each right angle electrical contact 250 may define a lead portion 255 that extends between the receptacle mating portion 270 and the receptacle compliant portion 260. Where the second electrical connector 210 is a right-angle connector, the lead portions 255 may define one or more angles. Each lead portion 255 may have a respective length, L-r. The right angle electrical contacts 250 may have different lengths, as shown, which may result in signal skew. Ideally, the lengths L-r of right angle electrical contacts 250 that form a differential signal pair 420 should vary by about 1 mm or less so that the signal skew is less than 10 picoseconds.

Figure 15:
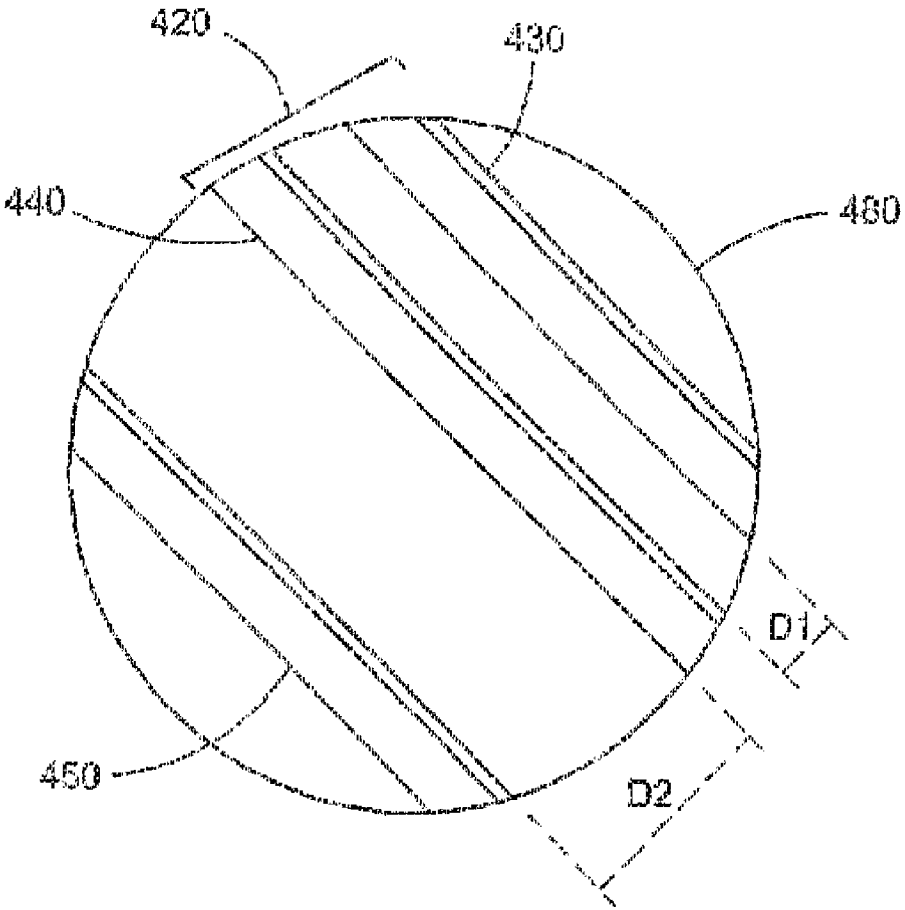
FIG. 15 is a detailed view of a portion of the right angle receptacle IMLA of FIG. 14.

Portion 460 is shown in greater detail in FIG. 15. FIG. 15 is a detailed view of the differential signal pair 420 and a ground contact 450 shown in FIG. 14. As shown in FIG. 15, each of the differential signal pairs 420 may include a first signal contact 430 and a second signal contact 440. The first and second signal contacts 430, 440 may be spaced apart by a distance D1 such that the first and second signal contacts 430, 440 are tightly electrically coupled to one another. The gap between the first signal contact 430 and the second signal contact 440, in plastic, may be about 0.2 to 0.8 mm depending on the height and material thickness of the contacts. A gap of about 0.25 mm to 0.4 mm is preferred. In air, the gap may be less. The adjacent ground contact 450 may be spaced apart by a distance D2 from the differential signal pair within the IMLA 220. The distance D2 may be approximately 1.5 to 4 times the distance D1. The D2 distance between the second signal contact 440 and the ground contact 450, may be approximately 0.3 to 0.8 mm in plastic. A D2 distance of about 0.4 mm is preferred. In air, the values may be smaller. As discussed above, the height or width of the first signal contact 430 and the second signal contact 440 may be approximately equal to the material thickness, although it may be greater than a material thickness. For example, the height may vary between about 0.1 mm to 0.9 mm.

The ground contact 450 may be similar in dimensions to the first and second signal contacts 430, 440 to optimize spacing between signals contacts and grounds to produce an electrical connector with a differential signal pair density greater than eighty-two differential signal pairs per inch of card edge, and a stacked card pitch distance of less than about 35 mm or 31 mm (about 25 mm preferred), and a back panel to rear connector length of less than about 37 mm (about 35 mm preferred). In addition, a second electrical connector with right angle electrical contacts and more than eighty-two differential pairs per inch of card edge and the associated interleaved ground contacts 450 rises less than 20 mm from a daughter card mounting surface and only occupies about 400 square millimeters of daughter card surface area.

Figure 16:
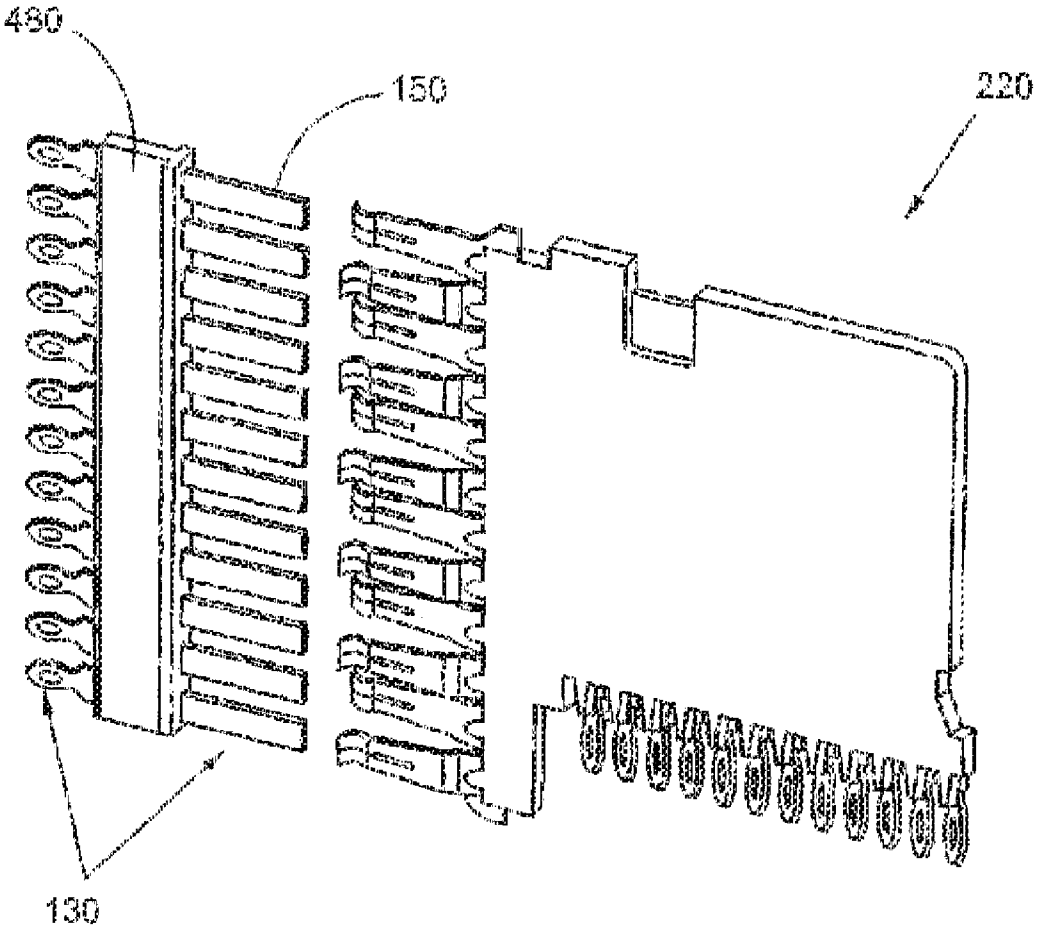
FIG. 16 depicts a header IMLA and a right angle receptacle IMLA.

FIG. 16 shows that the electrical contacts 130 of the first electrical connector 110 may have an insert molded housing 480 adjacent to the header mating portions 150. The insert molded housing 480 may hold electrical contacts 130 of differing electrical and physical lengths.

Figure 17:
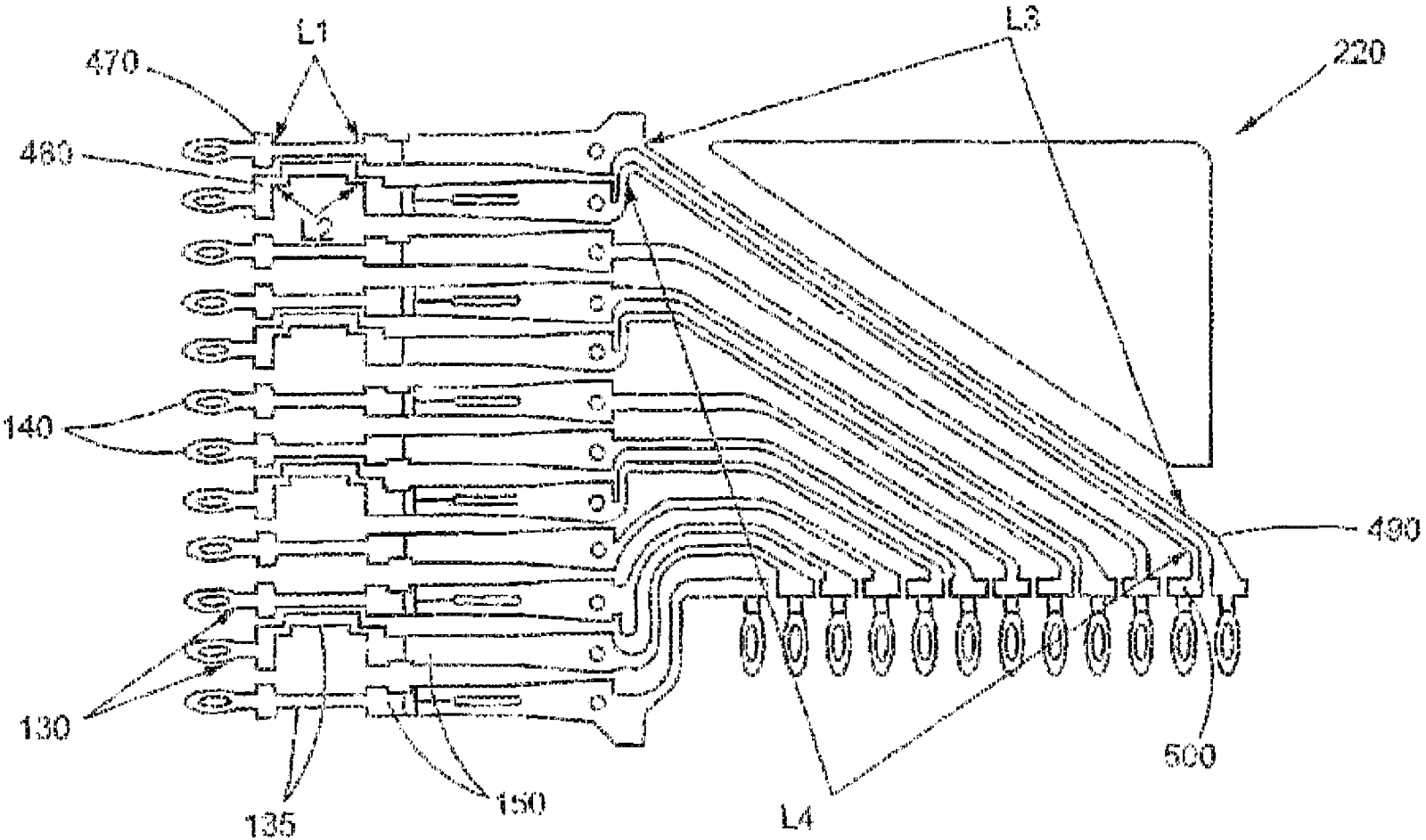
FIG. 17 depicts an array of electrical contacts mating with right angle electrical contacts.

FIG. 17 depicts the array of electrical contacts 130 and the IMLA 220 in FIG. 16 without the insert molded housing 480. The electrical contacts 130 may define a respective header lead portions 135 between each of the header compliant portions 140 and each of the header mating portions 150. The header lead portions 135 of adjacent contacts may vary in length. For example, a first electrical contact 470 may have a header lead portion 135 with a first physical and electrical length L1 and a second electrical contact 480 adjacent to the first electrical contact 470 may have a header lead portion 135 of a second physical and electrical length L2. In an example embodiment, the first length L1 may be less than the second length L2 to correct for skew in third and fourth electrical contacts 490 and 500.

For example, third electrical contact 490 may have a third physical and electrical length L3 and a fourth electrical contact 500 adjacent to the third electrical contact 490 may have a fourth physical and electrical length. In an example embodiment, the fourth physical and electrical length may be less than the third length. The third electrical contact 490 may be mated to the first electrical contact 470 and the fourth electrical contact 500 may be mated with the second electrical contact 480 such that the summation of the first physical and electrical length and the third physical and electrical length may be approximately equal to the summation of the second physical and electrical length and the fourth physical and electrical length. That is, the total electrical length between two contacts in a differential signal pair may be corrected for skew.

What is claimed is:

1. A vertical electrical connector configured to be mated to a mating right angle connector along a first direction, the electrical connector comprising:

a differential signal pair comprising a first vertical electrical contact retained by a dielectric housing, and a second vertical electrical contact that is retained by the dielectric housing and is disposed adjacent to the first vertical electrical contact, the first vertical electrical contact having a first end and a second end, the second vertical electrical contact having a first end and a second end, the first ends of the first and second vertical electrical contacts aligned with each other along the a direction that is perpendicular to the first direction, and the second ends of the first and second vertical electrical contacts aligned with each other along the direction that is perpendicular to the first direction, wherein (i) the first vertical electrical contact has a first length that extends from the first end of the first vertical electrical contact to the second end of the first vertical electrical contact, (ii) the second vertical electrical contact has a bent portion so as to define second length that extends from the first end of the second vertical electrical contact and the second end of the second vertical electrical contact, the bent portion being surrounded by the dielectric housing, and (iii) the first length is less than the second length, such that an electrical signal in the second electrical contact propagates through the second length longer than the electrical signal in the first electrical contact propagates through the first length to correct skew from a mating differential signal pair in the mating right angle connector.

2. The vertical connector as claimed in claim 1, wherein the first and second electrical contacts are insert molded in the dielectric housing.

3. The vertical connector as claimed in claim 1, wherein the first and second electrical contacts are stitched into the dielectric housing.

4. The vertical electrical connector as claimed in claim 1, wherein the electrical connector is devoid of metallic plates.

5. The vertical electrical connector as claimed in claim 1, further comprising a ground contact retained by the dielectric housing and positioned adjacent the differential signal pair, wherein the ground contact has a third length in the first direction that is less than the second length.

6. The vertical electrical connector as claimed in claim 5, wherein the third length is substantially equal to the first length.

7. The vertical electrical connector as claimed in claim 5, wherein the ground contact is disposed adjacent the first electrical contact.

8. The vertical electrical connector as claimed in claim 5, wherein the ground contact is disposed adjacent the second electrical contact.

9. The vertical electrical connector as claimed in claim 5, wherein the first and second electrical contacts are separated by a first distance and the differential signal pair is separated from the ground contact by a second distance that is greater than the first distance.

10. The vertical electrical connector as claimed in claim 1, wherein the first and second electrical contacts are header contacts.

11. The vertical electrical connector as claimed in claim 1, wherein the first and second electrical contacts define respective mating and mounting ends that are parallel to each other.

12. An electrical connector configured to mate with a second electrical connector along a mating direction, the electrical connector comprising:

a first electrical contact retained by a dielectric housing, the first electrical contact including at least a first portion that has a first end and a second end spaced from the first end and aligned with the first end along a direction that is parallel to the mating direction, wherein the first electrical contact has a first length from the first end to the second end of the first electrical contact along the first portion;

a second electrical contact retained by the dielectric housing and disposed adjacent to the first electrical contact, the second electrical contact including at least a second portion that has a first end and a second end spaced from the first end and aligned with the first end along a direction that is parallel to the mating direction, wherein the second electrical contact has a second length from the first end to the second end of the second electrical contact along the second portion; and a ground contact retained by the dielectric housing and positioned adjacent one of the first and second electrical contacts, the ground contact including at least a ground portion that has a first end and a second end spaced from the first end and aligned with the first end along a direction that is parallel to the mating direction, wherein the ground contact has a ground length from the first end to the second end of the ground contact along the ground portion;

wherein 1) the first end of the first portion, the first end of the second portion and the first end of the ground portion are all aligned with one another along a direction that is perpendicular to the mating direction, 2) the second end of the first portion, the second end of the second portion, and the second end of the ground portion are all aligned with one another along the direction that is perpendicular to the mating direction, and 3) the first length is less than the second length, such that the first electrical contact propagates an electrical signal along an entirety of the first length for a first time duration, and the second electrical contact propagates the electrical signal along an entirety of the second length for a second time duration that is longer than the first time duration, and the ground length is substantially equal to the first length.

13. The electrical connector as claimed in claim 12, comprising a vertical electrical connector.

14. The electrical connector as claimed in claim 12, wherein the electrical connector is devoid of metallic plates.

15. The vertical electrical connector as claimed in claim 12, wherein the ground length is substantially equal to the first length.

16. The vertical electrical connector as claimed in claim 12, wherein the ground contact is disposed adjacent the first electrical contact.

17. The vertical electrical connector as claimed in claim 16, wherein the first and second electrical contacts are separated by a first distance, and the first electrical contact is separated from the ground contact by a second distance that is greater than the first distance.

18. The vertical electrical connector as claimed in claim 12, wherein the ground contact is disposed adjacent the second electrical contact.

19. The vertical electrical connector as claimed in claim 18, wherein the first and second electrical contacts are separated by a first distance, and the second electrical contact is separated from the ground contact by a second distance that is greater than the first distance.

20. The electrical connector as claimed in claim 19, wherein the second distance is approximately 1.5 times greater than the first distance.

21. The electrical connector as claimed in claim 19, wherein the second distance is approximately two times greater than the first distance.

22. The electrical connector as claimed in claim 19, wherein the second distance is greater than two times greater than the first distance.

23. The electrical connector as claimed in claim 12, wherein the first and second electrical contacts define a differential signal pair.

24. The vertical electrical connector as claimed in claim 23, wherein the differential pair is a first differential pair, and the ground contact is a first ground contact, the vertical electrical connector further comprising:

a second differential pair that includes a third electrical contact retained by a dielectric housing, and a fourth electrical contact that is retained by the dielectric housing and is disposed adjacent to the third electrical contact, such that the ground contact is disposed between the first and second differential pairs; and a second ground contact retained by the dielectric housing, the second ground contact disposed adjacent the second differential pair such that the second differential pair is disposed between the first and second ground contacts, wherein (i) the third electrical contact has a third length in the first direction, (ii) the fourth electrical contact has a fourth length in the first direction, (iii) the third length being less than the fourth length.

25. The vertical electrical connector as claimed in claim 24, wherein the second electrical contact includes a bent portion that extends away from both the first and second ground contacts.

26. The vertical electrical connector as claimed in claim 25, wherein the bent portion of the second electrical contact extends toward the first electrical contact.

27. The vertical electrical connector as claimed in claim 25, wherein the fourth electrical contact includes a bent portion that extends away from the second ground contact and toward the first ground contact.

28. The vertical electrical connector as claimed in claim 27, wherein the bent portion of the fourth electrical contact extends toward the third electrical contact.

29. The electrical connector as claimed in claim 12, wherein the first and second electrical contacts are header contacts.

30. The electrical connector as claimed in claim 12, wherein the second electrical contact defines a bent portion between the first end of the second portion and the second end of the second portion, the bent portion defining a region that extends along a direction that includes the direction that is perpendicular to the mating direction.

31. The electrical connector as claimed in claim 30, wherein the region extends along the direction that is perpendicular to the mating direction.

* * * * *